US012365849B2

(12) United States Patent
Chappell et al.

(10) Patent No.: US 12,365,849 B2
(45) Date of Patent: Jul. 22, 2025

(54) LUBRICANT COMPOSITION CONTAINING METAL ALKANOATE

(71) Applicant: Infineum International Limited, Abingdon (GB)

(72) Inventors: Benjamin G. N. Chappell, Abingdon (GB); Mark Peter Driver, Abingdon (GB); Emily C. Mason, Abingdon (GB); Alice H. Leung, Reading (GB)

(73) Assignee: Infineum International Limited, Milton Hill (GB)

( * ) Notice: Subject to any disclaimer, the term of this patent is extended or adjusted under 35 U.S.C. 154(b) by 0 days.

(21) Appl. No.: 18/480,557

(22) Filed: Oct. 4, 2023

(65) Prior Publication Data

US 2024/0141252 A1 May 2, 2024

(30) Foreign Application Priority Data

Oct. 11, 2022 (GB) ..... 22200963

(51) Int. Cl.
*C10M 169/04* (2006.01)
*C10M 125/04* (2006.01)
(Continued)

(52) U.S. Cl.
CPC ..... *C10M 169/044* (2013.01); *C10M 125/04* (2013.01); *C10M 125/22* (2013.01);
(Continued)

(58) Field of Classification Search
CPC ..... C10M 169/044; C10M 125/04; C10M 125/22; C10M 129/54; C10M 129/70;
(Continued)

(56) References Cited

U.S. PATENT DOCUMENTS 3,102,096 A 8/1963 Nygaard
3,215,707 A 11/1965 Rense
(Continued)

FOREIGN PATENT DOCUMENTS

EP 0290457 A1 11/1988
EP 1350833 A2 10/2003
(Continued)

OTHER PUBLICATIONS

Felicio Luiz, Juli and Spikes, Hugh, *Triboflm Formation, Friction and Wear-Reducing Properties of Some Phosphorus-Containing Antiwear Additives*, Tribology Letters (2020) 68:75.
Search Report under Section 17 UK Intellectual Property Office for Application EP 23202318.4 dated Mar. 3, 2024.

*Primary Examiner* — Ellen M McAvoy
(74) *Attorney, Agent, or Firm* — Robert A. Migliorini

(57) ABSTRACT

This invention relates to a lubricating composition comprising or resulting from the admixing of: base oil, detergent, and one or more metal alkanoates having a quaternary carbon atom at the 2 position, the 2' position, or both the 2 and 2' positions, where the lubricating composition preferably has an adhesive wear of 100 hours or more, a foam volume of 70 ml or less at 24° C., and 50 ml or less at 93.5° C., and, optionally, a total base number of 7 mgKOH/g or more.

18 Claims, 2 Drawing Sheets

(51) Int. Cl.

| | |
|---|---|
| ***C10M 125/22*** | (2006.01) |
| ***C10M 129/54*** | (2006.01) |
| ***C10M 129/70*** | (2006.01) |
| ***C10M 139/00*** | (2006.01) |
| ***C10M 141/12*** | (2006.01) |
| ***C10M 155/02*** | (2006.01) |
| ***C10M 161/00*** | (2006.01) |
| ***F01M 9/02*** | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 30/18* | (2006.01) |
| *C10N 40/25* | (2006.01) |

(52) U.S. Cl.

CPC ..... *C10M 129/54* (2013.01); *C10M 129/70* (2013.01); *C10M 139/00* (2013.01); *C10M 141/12* (2013.01); *C10M 155/02* (2013.01); *C10M 161/00* (2013.01); *F01M 9/02* (2013.01); *C10M 2201/05* (2013.01); *C10M 2201/06* (2013.01); *C10M 2207/281* (2013.01); *C10M 2225/00* (2013.01); *C10M 2227/00* (2013.01); *C10M 2229/046* (2013.01); *C10M 2290/00* (2013.01); *C10N 2030/02* (2013.01); *C10N 2030/04* (2013.01); *C10N 2030/06* (2013.01); *C10N 2030/10* (2013.01); *C10N 2030/12* (2013.01); *C10N 2030/18* (2013.01); *C10N 2030/52* (2020.05); *C10N 2040/25* (2013.01); *C10N 2040/252* (2020.05)

(58) Field of Classification Search

CPC ..... C10M 139/00; C10M 141/12; C10M 155/02; C10M 161/00; C10M 2201/05; C10M 2201/06; C10M 2207/281; F01M 9/02; C10N 2040/25

See application file for complete search history.

(56) References Cited

U.S. PATENT DOCUMENTS

| | | | | |
|---|---|---|---|---|
| 4,866,139 | A | 9/1989 | Gutierrez | |
| 5,604,188 | A * | 2/1997 | Ryan | C10M 129/10 508/378 |
| 6,008,165 | A | 12/1999 | Shanklin | |
| 6,010,986 | A | 1/2000 | Stachew | |
| 6,294,507 | B1 | 9/2001 | Dahl | |
| 7,615,520 | B2 | 11/2009 | Esche, Jr. | |
| 8,603,954 | B2 | 12/2013 | Sauer | |
| 10,000,721 | B2 | 6/2018 | Schilowitz | |
| 10,119,093 | B2 | 11/2018 | Gao | |
| 10,640,724 | B2 | 5/2020 | Strong | |
| 10,781,397 | B2 | 9/2020 | Gooding | |
| 10,913,916 | B2 | 2/2021 | De Rooy | |
| 10,947,473 | B2 | 3/2021 | Casey | |
| 10,982,166 | B2 | 4/2021 | Guiducci | |
| 11,168,280 | B2 | 11/2021 | Clarke | |
| 2008/0128184 | A1 | 6/2008 | Loper | |
| 2008/0132432 | A1* | 6/2008 | Mathur | C10M 129/42 508/108 |
| 2008/0223330 | A1 | 9/2008 | Lam | |
| 2010/0292113 | A1 | 11/2010 | Guevremont | |
| 2016/0186089 | A1* | 6/2016 | Schilowitz | C10M 169/04 508/525 |
| 2018/0298301 | A1* | 10/2018 | Gooding | C10M 129/40 |
| 2018/0298302 | A1* | 10/2018 | Gooding | C10M 169/04 |
| 2019/0016985 | A1 | 1/2019 | Elliott | |
| 2019/0185778 | A1 | 6/2019 | Loop | |
| 2020/0277542 | A1 | 9/2020 | Salvi | |

FOREIGN PATENT DOCUMENTS

| | | | |
|---|---|---|---|
| EP | 1702973 | A1 | 9/2006 |
| EP | 3604488 | A1 | 2/2020 |
| EP | 3118286 | B1 | 8/2022 |
| JP | 2004-149762 | | 4/2003 |
| WO | WO 2002/062930 | | 8/2002 |
| WO | WO 2008/124191 | | 10/2008 |
| WO | WO 2011/161406 | | 12/2011 |
| WO | WO 2012/056191 | | 5/2012 |
| WO | WO 2021/071709 | A1 | 4/2021 |

* cited by examiner

LUBRICANT COMPOSITION CONTAINING METAL ALKANOATE

FIELD OF THE INVENTION

This invention relates to the use of metal alkanoates, such as zinc neodecanoate, as additives in lubricant compositions having good anti-wear properties, especially for heavy-duty diesel engine applications.

BACKGROUND OF THE INVENTION

The present invention relates to automotive lubricating oil compositions which exhibit improved friction characteristics. More specifically, the present invention relates to automotive crankcase lubricating oil compositions for use in gasoline (spark-ignited) and diesel (compression-ignited) internal combustion engines, such compositions being referred to as crankcase lubricants; and to the use of additives in such lubricating oil compositions for reducing friction and/or wear between moving parts in use of such engines and/or improving the fuel economy performance of an engine lubricated with the lubricating oil composition.

Engine durability is an important consideration in the choice of a lubricant, especially for heavy-duty diesel engine applications. Original equipment manufacturers are continuing to increase their oil drain intervals and the average lifetime of vehicles has steadily increased over the last few decades. Likewise, there is a trend towards use of ashless anti-wear agents, which have a lower impact on after-treatment systems, such as diesel particulate filters in heavy-duty diesel vehicles.

Environmental and regulatory requirements are driving a desire to improve the efficiency of the internal combustion engine. Lower viscosity lubricants require less energy to pump around an engine and thus can improve its fuel economy. However, lower viscosity lubricants result in thinner oil films between contacting engine parts (e.g., in the valve train, piston zone and in bearings), which can lead to higher rates of wear, reduced friction modification, etc. Conventionally, zinc dialkyl dithiophosphates (ZDDPs) are often used as lubricant additives to prevent engine wear and or reduce friction in the boundary lubrication regimes.

Alongside the drive for improved fuel economy, there is also a desire to reduce the emissions from vehicles. Control of exhaust emissions is typically achieved by after-treatment devices, such as catalytic convertors, which generally employ precious metal catalysts to convert combustion products into less undesirable species. However, these catalysts are poisoned by, inter alia, phosphorous and sulfur, which impacts their catalytic activity. Another after-treatment device is the particulate filter, which can be blocked by sulfated ash or sludge generated from combustion of heavy-duty diesel oils. Hence, the levels of sulfated ash, phosphorous, and sulfur (SAPS) derived from heavy-duty diesel oils are desirably reduced. ZDDP additives contribute significant quantities of SAPS to a lubricating oil, thus the use of ZDDP is also desirably reduced.

This makes the discovery of new anti-wear agents, which are typically inorganic materials, particularly those that reduce the levels of sulfated ash, phosphorous, and sulfur, advantageous.

A common feature of inorganic materials generally is that they often generate ash. As there are ash limits imposed by original equipment manufacturers and the like, it typically means that other ash forming components must be reduced to accommodate new inorganic materials. A main source of ash producing materials in lubricants are inorganic detergents, which are often added to increase the total base number of the lubricating oil. Raising the total base number can often mean that acidic byproducts of combustion are neutralized for a longer period or under more harsh conditions. However, total base numbers that are too high can also contribute to ash. Thus, when adding new inorganic materials, formulators will try to reduce the total base number by removing inorganic detergents, among other things.

Many anti-wear agents are inorganic materials based on metal salts of carboxylic acids, however these metal salts often have a negative impact on foaming properties of the lubricant, as well as the total base number of the lubricant. Therefore, it would be desirable to identify anti-wear agents, such as metal salts of carboxylic acids, that also preferably have excellent anti-foaming and total base number impact properties with little or no contribution to ash formation.

It has now surprisingly been found by the present inventors that metal salts of $C_{9+}$neoacid-based carboxylic acids, such as $C_{10+}$neoacid-based carboxylic acids, typically in combination with metal-based detergents can be used in a lubricant composition, such as in diesel engines, to provide wear and friction reduction, higher total base number, and preferably less foaming, when compared to metal salts of linear or partially branched carboxylic acids.

It has also been surprisingly found that the lubricating composition of the present invention reduces friction, thus helps provide improved fuel economy properties.

U.S. 2020/0277542 discloses metal salts of carboxylic acids, such as zinc stearate, as components in lubricant compositions.

U.S. 2019/0016985 discloses zinc carboxylates, such as zinc 2-ethylhexanoate, as components in lubricant compositions.

U.S. Pat. No. 10,000,721 and its U.S. continuation-in-part U.S. Pat. No. 10,781,397 disclose metal salts of carboxylic acids, such as zinc stearate, zinc undecylenate, zinc oleate, and zinc naphthenate, as anti-wear components in lubricant compositions.

U.S. Pat. No. 6,294,507 discloses liquid additive compositions including a metal carboxylate and carboxylic acid.

U.S. Pat. No. 5,604,188 discloses zinc alkanoates comprising a tertiary carbon attached to the COO— moiety.

U.S. Pat. No. 10,982,166 discloses a boron-containing additive used in a non-aqueous lubricant composition as an inhibitor of lead corrosion associated with ashless, organic ester, anti-wear additives and/or friction modifiers.

PCT WO2008/124191 relates to a lubricating composition comprising a major amount of a GTL (gas-to-liquid) lubricating base oil and a friction modifier consisting essentially of oil soluble fatty acid esters of a polyol, such as carboxylic acids containing 12 to 24 carbon atoms (including octadecanoic acid, dodecanoic acid, stearic acid, lauric acid, and oleic acid).

U.S. Pat. No. 11,168,280 describes a lubricant additive concentrate containing a low molecular weight hydrocarbyl or hydrocarbenyl succinic anhydride or succinimide compatibility aid, derived from a hydrocarbyl or hydrocarbenyl group having a number average molecular weight (Mn) of from about 150 to about 1200 daltons, such as octadecenyl succinic anhydride (ODSA) or polyisobutenyl succinic anhydride (PIBSA), preferably in an amount of from about 0.2 mass % to about 8 mass %.

EP 1 350 833 A2, at paragraphs [0040-0041] and Examples L and M in Table 4, discloses a 15W-40 heavy duty diesel oil blend which includes, inter alia, a combination containing bismuth diamyldithiocarbamate, zinc neodecanoate and optional Irganox™1. 150 (reported to be a mixture of high molecular weight aminic and phenolic antioxidants) that is reported to reduce soot induced viscosity.

EP 3 118 286 B1 discloses lubricant composition containing an oil-soluble titanium-containing material oil-soluble titanium-containing material having a number average molecular weight of less than 20,000, having beneficial effects on properties such as deposit control, oxidation, and filterability in, for instance, engine oils, where titanium isopropoxide impart[s] a beneficial effect in one or more of the Komatsu Hot Tube Deposits screen test (KHT), the KES Filterability test, the Dispersant Panel Coker test (a test used to evaluate the deposit-forming tendency of an engine oil) and the Cat 1M-PC test.

Other references of interest include: Juli Felicio Luiz and Hugh Spikes, Tribofim Formation, Friction and Wear-Reducing Properties of Some Phosphorus-Containing Antiwear Additives, Tribology Letters (2020) 68:75; U.S. Pat. Nos. 3,102,096; 4,866,139; 6,008,165; 6,010,986; 8,603,954; 10,640,724; 10,913,916; 7,615,520; 10,119,093; 10,947,473; WO 2002/062930; WO 2011/161406; WO 2012/056191; WO 2021/071709A1; U.S. 2008/0128184; U.S. 2010/0292113; U.S. 2008/223330 A1; U.S. 2019/185778 A1; EP 1 702 973 A1; and JP 2004-149762.

SUMMARY OF THE INVENTION

This invention relates to a lubricating oil composition comprising or resulting from the admixing of: (i) base oil, (ii) detergent, and (iii) one or more metal alkanoates having a quaternary carbon atom at the 2 position and/or at the 2' position. (The 2 and 2' positions are the carbons attached to the COO— moieties in the metal alkanoate. For example, the 2 position in the formula below is the carbon atom attached to the $R^4$, $R^5$, and $R^6$ groups and the 2' position is the carbon atom attached to the $R^1$, $R^2$, and $R^3$ groups.)

This invention also relates to a lubricating oil composition comprising or resulting from the admixing of: (i) base oil, (ii) detergent, and (iii) one or more metal alkanoates represented by the Formula (I):

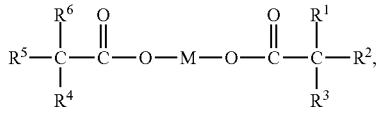

(I)

wherein,

M is a group 4, 5, 10, 11, 12, or 13 metal;

each of $R^1$, $R^2$, and $R^3$ is hydrogen or a $C_1$ to $C_{20}$ linear, branched, or cyclic alkyl group; each of $R^4$, $R^5$ and $R^6$ are, independently, a $C_1$ to $C_{20}$ linear, branched, or cyclic alkyl group.

In embodiments M is not a group 4 metal, such as M is not Ti, Zr or Hf. In embodiments metal alkanoates represented by the Formula (I) are not titanium neodecanoate, and or zirconium neodecanoate, and or hafnium neodecanoate.

In embodiments M is not a group 7 metal, such as M is not Mn, Tc, or Rh.

In embodiments M is not a group 15 metal, such as M is not Sb or Bi.

In embodiments, antimony dithiocarbamate and or bismuth dithiocarbamate anti-oxidant are absent.

Preferably, the lubricating oil composition has:

a) an adhesive wear of 100 hours or more (as determined by ASTM D8074-16, also referred to as "DD-13 scuffing test"), and optionally b) a foam volume of 70 ml or less at 24° C. and 50 ml or less at 93.5° C. (as determined by ASTM D892, option A), and optionally c) a total base number of 7 mgKOH/g or more (as determined by ASTM D2896).

Preferably, the lubricating oil composition has:

a) an adhesive wear of 100 hours or more (as determined by ASTM 8074-16), and b) a foam volume of 70 ml or less at 24° C. and 50 ml (such as 30 ml) or less at 93.5° C. (as determined by ASTM D892, option A), and c) a total base number of 7 mgKOH/g or more (as determined by ASTM D2896).

According to another aspect of the present invention, there is provided the use of a lubricating oil composition comprising or resulting from the admixing of (i) base oil, (ii) detergent, and (iii) one or more alkanoates represented by the Formula (I) above for providing reduced wear, such as more than a 10% difference in wear as compared to the same composition without the alkanoates represented by the Formula (I) above.

According to yet a further aspect of the present invention, there is provided the use of a lubricating oil composition comprising or resulting from the admixing of (i) base oil, (ii) detergent, and (iii) one or more alkanoates represented by the Formula (I) above for providing reduced friction, such as more than a 10% difference in friction as compared to the same composition without the alkanoates represented by the Formula (I) above.

According to yet a further aspect of the present invention, there is provided the use of a lubricating oil composition comprising or resulting from the admixing of (i) base oil, (ii) detergent, and (iii) one or more alkanoates represented by the Formula (I) above for providing reduced friction and wear such as more than a 10% difference in wear and more than a 10% difference in friction, as compared to the same composition without the alkanoates represented by the Formula (I) above.

According to yet a further aspect of the present invention, there is provided the use of a lubricating oil composition comprising or resulting from the admixing of (i) base oil, (ii) detergent, and (iii) one or more alkanoates represented by the Formula (I) above for providing improved fuel economy, as more than a 10% difference in fuel economy as compared to the same composition without the alkanoates represented by the Formula (I) above.

According to yet a further aspect of the present invention, there is provided the use of a lubricating oil composition comprising or resulting from the admixing of (i) base oil, (ii) detergent, and (iii) one or more alkanoates represented by the Formula (I) above for providing reduced friction and wear, low foaming, and/or low total base number impact, e.g., more than a 10% difference of each property as compared to the same composition without the alkanoates represented by the Formula (I) above.

According to yet a further aspect of the present invention, there is provided a heavy-duty diesel lubricating oil composition comprising or resulting from the admixing of (i) base oil, (ii) detergent, and (iii) one or more alkanoates represented by the Formula (I) above having reduced friction and wear, low foaming, and or low total base number impact, e.g., more than a 10% difference of each property as compared to the same composition without the alkanoates represented by the Formula (I) above.

According to yet a further aspect of the present invention, there is provided the use of a lubricating oil composition comprising or resulting from the admixing of (i) base oil, (ii) detergent, and (iii) one or more alkanoates represented by the Formula (I), where the lubricant has:

a) an adhesive wear of 100 hours or more (as determined by ASTM D8074-16), and b) a foam volume of 70 ml or less at 24° C. and 50 ml (such as 30 ml) or less at 93.5° C. (as determined by ASTM D892, option A), and c) a total base number of 7 mgKOH/g or more (as determined by ASTM D2896).

According to yet a further aspect of the present invention, there is provided a crankcase lubricating oil composition having more than 800 (such as more than 1000) ppm of zinc and less than 1000 ppm phosphorus.

According to yet a further aspect of the present invention, there is provided a crankcase lubricating oil composition having a ratio of zinc to phosphorus of 1.1 to 4.8 (such as 1.1 to 4.7, or 1.2 to 4.7, or 1.3 to 4.5, or 2.5 to 4.0) by wt %.

According to yet a further aspect of the present invention, there is provided a crankcase lubricating oil composition having: 1) an adhesive wear of 100 hours or more (as determined by ASTM D8074-16), and 2) more than 800 ppm of zinc and less than 1000 ppm phosphorus, and or a ratio of zinc to phosphorus of 1.1 to 4.8 (such as 1.1 to 4.7, or 1.2 to 4.7, or 1.3 to 4.5, or 2.5 to 4.0) by wt %.

According to yet a further aspect of the present invention, there is provided a crankcase lubricating oil composition comprising or made by admixing:

(i) one or more base oils, in a major amount;

(ii) one or more metal alkanoates represented by the Formula (I):

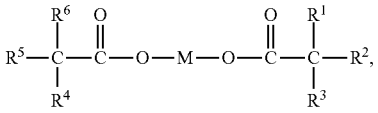

(I)

wherein,

M is a group 4, 5, 10, 11, 12, or 13 metal (preferably where M is not a group 4 metal, such as M is not Ti Zr, or Hf);

each of $R^1$, $R^2$, and $R^3$ is hydrogen or a $C_1$ to $C_{20}$ linear, branched, or cyclic alkyl group;

each of $R^4$, $R^5$ and $R^6$ are, independently, a $C_1$ to $C_{20}$ linear, branched, or cyclic alkyl group;

where the one or more metal alkanoates provide from 600-1500 ppm of M atoms to the lubricating oil composition;

(iii) a detergent composition comprising one or more calcium sulfonate, magnesium sulfonate, or both calcium sulfonate and magnesium sulfonate detergents in an amount providing from 200 to 4000 ppm calcium, magnesium or calcium and magnesium atoms, respectively, to the lubricating oil composition, measured according to ASTM D5185;

(iv) optionally, an oil-soluble or oil-dispersible boron-containing compound present in the lubricating oil composition in an amount sufficient to provide from 200-600 ppm boron atoms to the lubricating oil composition, measured according to ASTM D5185; and (v) optionally, an oil-soluble or oil-dispersible molybdenum-containing additive, providing from 60 (such as 600)-1500 ppm of molybdenum atoms to the lubricating oil composition.

In another aspect, the lubricating oil compositions described herein contain from 600 to 4000 ppm of group 4, 5, 10, 11, 12, or 13 metal, alternately the lubricating oil compositions described herein contain from 500 to 3000 ppm of group 10, 11, 12, or 13 metal, preferably the lubricating oil composition described herein contain from 500 to 3000 ppm metal selected from the group consisting of nickel, palladium, platinum, copper, silver, gold, zinc, tin, zirconium, hafnium, titanium, vanadium, niobium, and tantalum, alternately the lubricating oil composition described herein contain from 500 to 3000 ppm of zinc.

This invention also relates to a lubricating oil composition comprising or resulting from the admixing of: (i) base oil, (ii) detergent, and (iii) one or more zinc alkanoates, where the lubricating oil composition comprises at least 600 ppm zinc, wherein the lubricating oil composition has: a) an adhesive wear of 100 hours or more, as determined by ASTM D8074-16, and b) a foam volume of 70 ml or less at 24° C. and 50 ml or less at 93.5° C., as determined by ASTM D892, option A.

This invention also relates to a lubricating oil composition comprising or resulting from the admixing of: (i) base oil, (ii) detergent, and (iii) one or more zinc alkanoates, where the lubricating oil composition comprises at least 1500 ppm zinc, wherein the lubricating oil composition has: a) an adhesive wear of 100 hours or more, as determined by ASTM D8074-16, and b) a foam volume of 70 ml or less at 24° C. and 50 ml or less at 93.5° C., as determined by ASTM D892, option A.

This invention relates to a lubricating oil composition comprising or resulting from the admixing of:

(i) one or more base oils, in a major amount;

(ii) one or more metal alkanoates represented by the Formula (I):

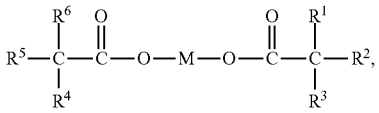

(I)

wherein,

M is a group 4, 5, 10, 11, 12, or 13 metal (preferably where M is not a group 4 metal, such as M is not Ti, Zr or Hf);

each of $R^1$, $R^2$, and $R^3$ is hydrogen or a $C_1$ to $C_{20}$ linear, branched, or cyclic alkyl group;

each of $R^4$, $R^5$ and $R^6$ are, independently, a $C_1$ to $C_{20}$ linear, branched, or cyclic alkyl group;

where the one or more metal alkanoates provide from 600-1500 ppm of M atoms to the lubricating oil composition; and (iii) a detergent composition comprising one or more calcium sulfonate, magnesium sulfonate, or both calcium sulfonate and magnesium sulfonate detergents in an amount providing from 200 to 4000 ppm calcium, magnesium or calcium and magnesium atoms, respectively, to the lubricating oil composition, measured according to ASTM D5185.

DEFINITIONS

Figure 1:
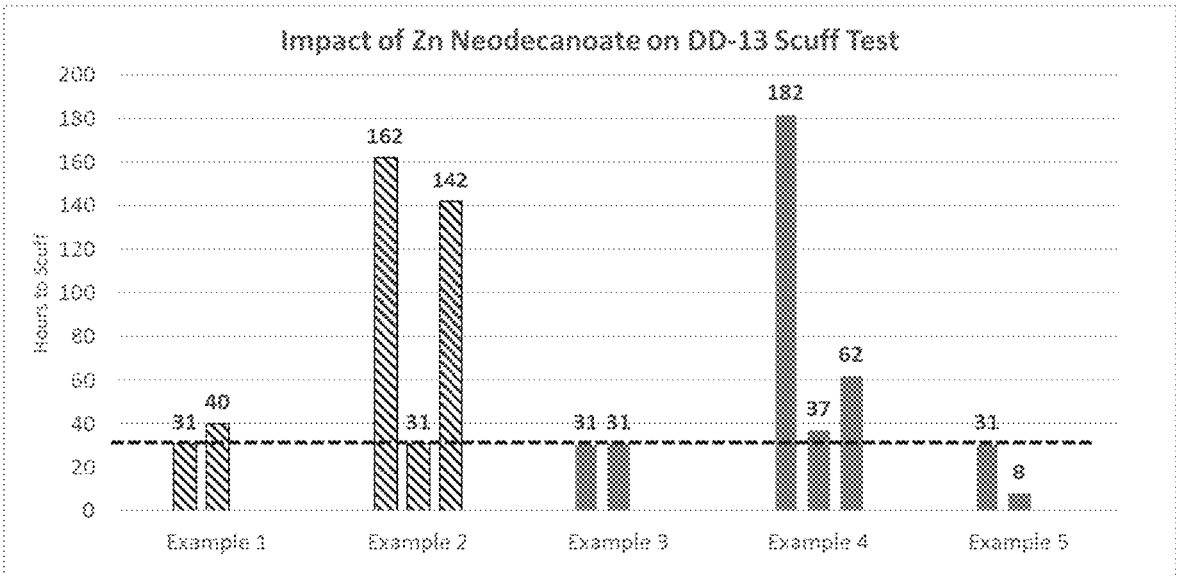
FIG. 1 (FIG. 1) is a graph illustrating adhesive wear data for blends containing zinc neodecanoate (Examples 2, 4, & 5). Examples 1 and 3 do not contain zinc neodecanoate.
Figure 2:
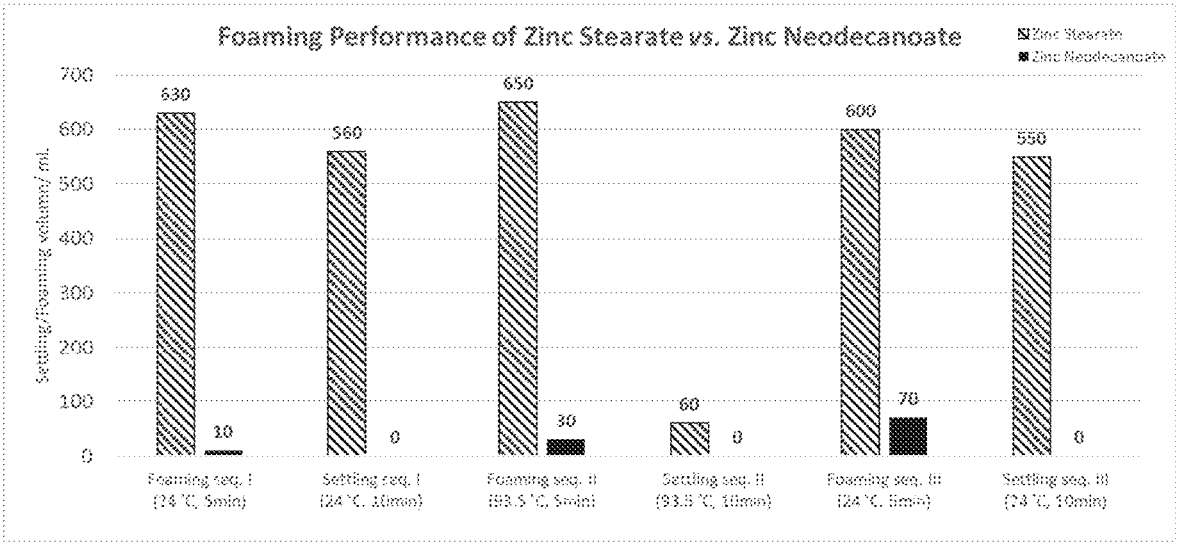
FIG. 2 (FIG. 2) is a graph illustrating the foaming performance of Examples 6 and 7 containing zinc neodecanoate (crosshatch) as compared to blends containing zinc stearate (solid).

For purposes of this specification and all claims to this invention, the following words and expressions, if and when used, have the meanings ascribed below.

For purposes herein, the new numbering scheme for the Periodic Table of the Elements is used as set out in Chemical and Engineering News, 63(5), 27 (1985). Alkali metals are Group 1 metals (e.g., Li, Na, K, etc.). Alkaline earth metals are Group 2 metals (e.g., Mg, Ca, Ba, etc.).

The expressions "consists of" or "consists essentially of" or cognates may be embraced within "comprises" or cognates, where "consists essentially of" permits inclusion of substances not materially affecting the characteristics of the composition to which it applies.

The term "major amount" means more than 50 mass % of a composition, such as more than 60 mass % of a composition, such as more than 70 mass % of a composition, such as from 80 to 99.9 mass % of a composition, such as from 80 to 99.009 mass % of a composition, based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "mass %" means mass percent of a component, based upon the mass of the composition as measured in grams, unless otherwise indicated, and is alternately referred to as weight percent ("weight %", "wt %" or "% w/w").

The term "active ingredient" (also referred to as "a.i." or "A.I.") refers to additive material that is neither diluent nor solvent.

The terms "oil-soluble" and "oil-dispersible," or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The terms "group" and "radical" are used interchangeably herein.

The term "hydrocarbon" means a compound of hydrogen and carbon atoms. A "heteroatom" is an atom other than carbon or hydrogen. When referred to as "hydrocarbons," particularly as "refined hydrocarbons," the hydrocarbons may also contain one or more heteroatoms or heteroatom-containing groups (such as halo, especially chloro and fluoro, amino, alkoxyl, mercapto, alkylmercapto, nitro, nitroso, sulfoxy, etc.) in minor amounts [e.g., where the heteroatom(s) do not substantially alter the hydrocarbon properties of the hydrocarbon compound].

The term "hydrocarbyl" means a radical that contains hydrogen and carbon atoms. Preferably, the group consists essentially of, more preferably consists only of, hydrogen and carbon atoms, unless specified otherwise. Preferably, the hydrocarbyl group comprises an aliphatic hydrocarbyl group. The term "hydrocarbyl" includes "alkyl," "alkenyl," "alkynyl," and "aryl" as defined herein. Hydrocarbyl groups may contain one or more atoms/groups other than carbon and hydrogen provided they do not affect the essentially hydrocarbyl nature of the hydrocarbyl group. Those skilled in the art will be aware of such atoms/groups (e.g., halo, especially chloro and fluoro, amino, alkoxyl, mercapto, alkylmercapto, nitro, nitroso, sulfoxy, etc.).

The term "alkyl" means a radical of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e., unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethylhexyl, nonyl, decyl, undecyl, dodecyl, tridecyl, tetradecyl, pentadecyl, hexadecyl, heptadecyl, octadecyl, nonadecyl, icosyl, and triacontyl.

The term "alkene" means a compound of carbon and hydrogen (such as a $C_2$ to $C_{30}$ radical, such as a $C_2$ to $C_{12}$ radical) having at least one double bond.

The term "alkenyl" means a radical of carbon and hydrogen (such as a $C_2$ to $C_{30}$ radical, such as a $C_2$ to $C_{12}$ radical) having at least one double bond. Alkenyl groups in a compound are typically bonded to the compound directly via a carbon atom. Unless otherwise specified, alkenyl groups may be linear (i.e., unbranched) or branched, be cyclic, acyclic or part cyclic/acyclic.

The term "alkylene" means a $C_1$ to $C_{20}$, preferably a $C_1$ to $C_{10}$, bivalent saturated aliphatic radical which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene.

The term "alkynyl" means a $C_2$ to $C_{30}$ (such as a $C_2$ to $C_{12}$) radical which includes at least one carbon-to-carbon triple bond.

The term "aryl" means a group containing at least one aromatic ring, such as a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom-containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with a hydrocarbon group, a heteroatom, or a heteroatom-containing group. An alkyl substituted derivative means a hydrogen atom has been replaced with an alkyl group. An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethylhexyl, nonyl, decyl, undecyl, dodecyl, tridecyl, tetradecyl, pentadecyl, hexadecyl, heptadecyl, octadecyl, nonadecyl, icosyl, and/or triacontyl.

The term "halogen" or "halo" means a group 17 atom or a radical of group 17 atom, such as fluoro, chloro, bromo, and iodo.

The term "ashless" in relation to an additive means the additive does not include a metal.

The term "ash-containing" in relation to an additive means the additive includes a metal.

The term "effective amount" in respect of an additive means an amount of such an additive in a lubricating oil composition so that the additive provides the desired technical effect.

The term "effective minor amount" in respect of an additive means an amount of such an additive of less than 50 mass % of the lubricating oil composition so that the additive provides the desired technical effect.

The term "ppm" means parts per million by mass, based on the total mass of the lubricating oil composition, unless otherwise indicated.

The term "metal content" of a lubricating oil composition or of an additive component, for example magnesium content, molybdenum content or total metal content (i.e., the sum of all individual metal contents), is measured by ASTM D5185.

The term "Total Base Number" also referred to as "TBN" in relation to an additive component or of a lubricating oil composition (i.e., unused lubricating oil composition) means total base number as measured by ASTM D2896.

The term "Total Acid Number" also referred to as "TAN" means total acid number as measured by ASTM D664.

The term "adhesive wear" is determined by ASTM D8074-16, which is also referred to as the DD13 Scuffing Test.

"Phosphorus content" is measured by ASTM D5185.

"Sulfur content" is measured by ASTM D2622.

"Sulfated ash content" is measured by ASTM D874.

"Zinc content" is measured by ASTM D5185.

The term "neo acids" means carboxylic acids that exhibit highly branched structures in which the carboxylic acid functional group is attached to a quaternary carbon atom and where the other moieties bonded to the quaternary carbon are saturated linear, branched, or cyclic alkyl groups.

"Neodecanoic acid" is a mixture of $C_{10}$ neo acids with the common structural formula $C_{10}H_{20}O_2$. Components of the mixture are acids with the common property of three alkyl groups at carbon two, including, but not limited to: 2,2,3,5-tetramethylhexanoic acid, 2,4-dimethyl-2-isopropylpentanoic acid, 2,5-dimethyl-2-ethylhexanoic acid, 2,2-dimethyloctanoic acid, and 2,2-diethylhexanoic acid.

The term "aliphatic hydrocarbyl fatty acid" means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein Cx to Cy designates the total number of carbon atoms in the aliphatic hydrocarbyl chain of the fatty acid, the fatty acid itself due to the presence of the carboxyl carbon atom includes a total of Cx+1 to Cy+1 carbon atoms). Preferably, the aliphatic hydrocarbyl fatty acid, inclusive of the carboxyl carbon atom, has an even number of carbon atoms. The aliphatic hydrocarbyl chain of the fatty acid may be saturated or unsaturated (i.e., includes at least one carbon-to-carbon double bond); preferably, the aliphatic hydrocarbyl chain is unsaturated and includes at least one carbon-to-carbon double bond—such fatty acids may be obtained from natural sources (e.g., derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e., includes at least one carbon-to-carbon double bond) to permit reaction with other agents, such as sulfur, to form the corresponding functionalized, such as sulfurized, aliphatic hydrocarbyl fatty acid ester(s).

The term "aliphatic hydrocarbyl fatty acid ester" means an ester obtainable by converting the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester. Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), [e.g., aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s)]. Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit functionalization, such as sulfurization, of the aliphatic hydrocarbyl fatty acid ester(s) a proportion of the aliphatic hydrocarbyl chain(s) of the fatty acid ester(s) is unsaturated and includes at least one carbon-to-carbon double bond.

The term "sulfurized aliphatic hydrocarbyl fatty acid ester" means a compound obtained by sulfurizing an aliphatic hydrocarbyl fatty acid ester as defined herein.

The term "absent" as it relates to components included within the lubricating oil compositions described herein and the claims thereto means that the particular component is present at 0 wt %, based upon the weight of the lubricating oil composition, or if present in the lubricating oil composition the component is present at levels that do not impact the lubricating oil composition properties, such as less than 10 ppm, or less than 1 ppm or less than 0.001 ppm.

Kinematic viscosity (KV100, KV40) is determined pursuant to ASTM D445-19a and reported in units of cSt, unless otherwise specified.

Unless otherwise indicated, all percentages reported are mass % on an active ingredient basis, i.e., without regard to carrier or diluent oil.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention. Accordingly, preferred and more preferred features of one aspect of the present invention may be independently combined with other preferred and/or more preferred features of the same aspect or different aspects of the present invention.

DETAILED DESCRIPTION OF THE INVENTION

The features of the invention relating, where appropriate, to each and all aspects of the invention, will now be described in more detail as follows.

The lubricating oil compositions of the invention comprise components that may or may not remain the same chemically before and after mixing with an oleaginous carrier (such as a base oil) and/or other additives. This invention encompasses compositions which comprise the components before mixing, or after mixing, or both before and after mixing.

Further, it is understood that any upper and lower quantity, range and ratio limits set forth herein may be independently combined.

Lubricating Oil Compositions

This invention relates to lubricating oil compositions (also referred to as "lubricant compositions," "lubricating compositions," or "lubricant oil compositions") comprising or resulting from the admixing of:

(i) from 1 to 99 mass % (alternately 30 to 95 mass %, alternately 50 to 90 mass %, alternately 60 to 95 mass %, alternately 70 to 85 mass %) of one or more base oils, based upon the weight of the lubricating composition;

(ii) from 0.10 to 20 mass % (in particular 0.15 to 10 mass %, alternately 0.20 mass % to 5 mass %, alternately 0.25 to 2 mass %), based upon the weight of the composition, of one or more detergents;

(iii) from 0.1 to 5 mass % (in particular 0.5 to 3 mass %, alternately 0.75 to 2 mass %, alternately 0.75 to 1.5 mass %), based upon the weight of the composition, of one or more metal alkanoates represented by the Formula (I):

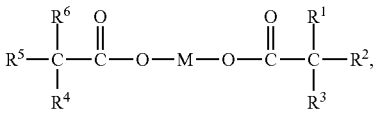

(I)

where, M is a group 4, 5, 10, 11, 12, or 13 metal, such as gold, silver, palladium, platinum, zirconium, vanadium, nickel, copper, zinc, aluminum or mixtures of 2, 3, 4, 5, 6, 7, or 8 metals, such as 2 or 3 of zinc, nickel, copper, and aluminum, or such as zinc(alternately, M is not group 4, and or group 7, and/or group 15 metal, such as M is not Ti, Zr, Hf, Sb or Bi); and each of $R^1$, $R^2$, and $R^3$ is hydrogen or a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, each of $R^4$, $R^5$, and $R^6$ is, independently, a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, where $R^1+R^2+R^3=7$ or more carbon atoms, i.e., the sum of the number of carbon atoms in $R^1$, $R^2$, and $R^3$ is 7 or more carbon atoms (alternately from 7 to 40, alternately from 8 to 22, alternately 7, 8, 9, 10, 11, 12, 13, or 14 carbon atoms) and $R^4+R^5+R^6=7$ or more carbon atoms, i.e., the sum of the number of carbon atoms in $R^4$, $R^5$, and $R^6$ is 7 or more carbon atoms (alternately from 7 to 40, alternately from 8 to 22, alternately 7, 8, 9, 10, 11, 12, 13, or 14 carbon atoms), and where the lubricating oil composition has:

a) an adhesive wear of 100 hours or more, such as 120 hours or more, such as 130 hours or more, such as 140 hours or more, (as determined by ASTM D8074-16), and b) a foam volume of 70 ml or less at 24° C. and 50 ml or less at 93.5° C., such as a foam volume of 60 ml or less at 24° C. and 40 ml or less at 93.5° C., such as a foam volume of 50 ml or less at 24° C. and 30 ml or less at 93.5° C., preferably such as a foam volume of 70 ml to 0 ml (such as 70 to 20 ml) at 24° C. and 30 ml to 0 such as 50 to 20 ml at 93.5° C. (as determined by ASTM D892, option A), and c) a total base number of 7 mgKOH/g or more, such as 7 to 15 mgKOH/g, such as 7 to 12 mgKOH/g, such as 7.5 to 11 mgKOH/g, such as 8 to 10 mgKOH/g (as determined by ASTM D2896); and d) optionally, a settling volume of 0 mL at 24 C and 93.5° C. (as determined by ASTM D 892, option A).

This invention also relates to a lubricating oil composition comprising or resulting from the admixing of: (i) base oil, (ii) detergent, and (iii) one or more zinc alkanoates, where the lubricating oil composition comprises at least 1000 ppm zinc (such as at least 1500 ppm), wherein the lubricating oil composition has:

a) an adhesive wear of 100 hours or more, such as 120 hours or more, such as 130 hours or more, such as 140 hours or more, (as determined by ASTM D8074-16), and b) a foam volume of 70 ml or less at 24° C. and 50 ml or less at 93.5° C., such as a foam volume of 60 ml or less at 24° C. and 40 ml or less at 93.5° C., such as a foam volume of 50 ml or less at 24° C. and 30 ml or less at 93.5° C., preferably such as a foam volume of 70 ml to 0 ml (such as 70 to 20 ml) at 24° C. and 30 ml to 0 such as 50 to 20 ml at 93.5° C. (as determined by ASTM D892, option A).

This invention also relates to lubricating oil compositions comprising or resulting from the admixing of:

A) from 1 to 99 mass % (alternately 30 to 95 mass %, alternately 50 to 90 mass %, alternately 60 to 95 mass %, alternately 70 to 85 mass %) based upon the weight of the lubricating composition, of one or more base oils;

B) from 0.1 to 5 wt % (in particular 0.5 to 3 mass %, alternately 0.75 to 2 mass %, alternately 0.75 to 1.5 mass %), based on total weight of the lubricating composition, of one or more metal alkanoates described herein, in particular, those represented by Formula (I) described above;

C) from 0.1 to 20 wt % (in particular 0.5 to 8 mass %, alternately 0.5 to 2.3 mass %), based on total weight of the lubricating composition, of one or more detergents (such as blends of detergents);

D) optionally, from 0.01 to 5 wt % (in particular 0.1 to 4 mass %, alternately 0.25 to 3 mass %), based on total weight of the lubricating composition, of one or more friction modifiers (such as blends of friction modifiers);

E) optionally, from 0.01 to 5 wt % (in particular 0.01 to 3 mass %, alternately 0.1 to 1.5 mass %), based on total weight of the lubricating composition, of one or more antioxidants (such as blends of antioxidants);

F) optionally, from 0.01 to 5 wt % (in particular 0.01 to 3 mass %, alternately 0.1 to 1.5 mass %), based on total weight of the lubricating composition, of one or more pour point depressants (such as blends of pour point depressants);

G) optionally, from 0.001 to 5 wt % (in particular 0.01 to 3 mass %, alternately 0.1 to 1.5 mass %), based on total weight of the lubricating composition, of one or more anti-foam agents (such as blends of anti-foam agents);

H) optionally, from 0.001 to 6 wt % (in particular 0.01 to 5 mass %, alternately 0.1 to 4 mass %, alternately 0.1 to 2 mass %, alternately 0.1 to 1 mass %), based on total weight of the lubricating composition, of one or more viscosity modifiers (such as blends of viscosity modifiers);

I) optionally, from 0.01 to 20 wt % (in particular 0.1 to 12 mass %, alternately 0.1 to 8 mass %), based on total weight of the lubricating composition, of one or more dispersants (such as blends of dispersants);

J) optionally, from 0.01 to 5 wt % (in particular 0.1 to 3 mass %, alternately 0.1 to 1.5 mass %), based on total weight of the lubricating composition, of one or more inhibitors and/or anti-rust agents (such as blends of inhibitors and/or anti-rust agents); and/or K) optionally, from 0.001 to 5 wt % (in particular 0.1 to 3 mass %, alternately 05 to 1.5 mass %), based on total weight of the lubricating composition, of one or more anti-wear agents (such as blends of anti-wear agents), where the lubricant has:

a) an adhesive wear of 100 hours or more, such as 120 hours or more, such as 130 hours or more, such as 140 hours or more, such as 120 hours to 200 hours, and b) optionally a foam volume of 70 ml or less at 24° C. and 50 ml or less at 93.5° C., such as a foam volume of 60 ml or less at 24° C. and 40 ml or less at 93.5° C., such as a foam volume of 50 ml or less at 24° C. and 30 ml or less at 93.5° C., preferably such as a foam volume of 70 ml to 0 ml (such as 70 to 20 ml) at 24° C. and 30 ml to 0 such as 50 to 20 ml at 93.5° C. (as determined by ASTM D892, option A), and c) optionally a total base number of 7 mgKOH/g or more, such as 7 to 15 mgKOH/g, such as 7 to 12 mgKOH/g, such as 7.5 to 11 mgKOH/g, such as 8 to 10 mgKOH/g (as determined by ASTM D2896).

For purposes of this invention and the claims thereto, component B) metal alkanoates are not added in the elements C, D, E, F G, H, I, J, and/or K above for determining weight percents, even though they may show similar properties, e.g., element B) metal alkanoates impact wear positively, but are not added into element K) for determining weight percent of anti-wear agents.

In embodiments, all of elements D, E, F G, H, I, J, and K are present in addition to the base oil, detergent, and the one or more metal alkanoates represented by the Formula (I) described above.

In embodiments, elements D, E, F G, H, I, and J are present in addition to the base oil, detergent, and the one or more metal alkanoates represented by the Formula (I) described above.

In embodiments, elements I, F, and G are present in addition to the base oil, detergent, and the one or more metal alkanoates represented by the Formula (I) described above.

In embodiments, elements D, E, F G, H, I, and J are present in addition to the base oil, detergent, and the one or more metal alkanoates represented by the Formula (I) described above.

In embodiments, elements I, F, and G are present in addition to the base oil, detergent, and the one or more metal alkanoates represented by the Formula (I) described above.

Suitably, the lubricant composition may have an adhesive wear of 100 hours or more, alternately 120 hours or more, alternately 130 hours or more, alternately 140 hours or more, such as 100 to 200 hours as measured by ASTM D8074.

Suitably, the lubricant composition may have a foam volume at 24° C. of 70 ml or less, alternately 50 ml or less, alternately 30 ml or less, such as 1 to 70 ml, such as 0 to 70 ml, as measured by ASTM D892, option A.

Suitably, the lubricant composition may have a foam volume at 93° C. of 50 ml or less, alternately 30 ml or less, alternately 20 ml or less, alternately 10 ml or less, such as 1 to 50 ml, such as 0 to 30 ml, as measured by ASTM D892, option A.

Suitably, the lubricant composition may have a foam volume at 24° C. of 70 ml or less, alternately 50 ml or less, alternately 30 ml or less, such as 1 to 70 ml, and a foam volume at 93.5° C. of 30 ml or less, alternately 20 ml or less, alternately 10 ml or less, such as 1 to 30 ml, as measured by ASTM D892.

Suitably, the lubricant composition may have a total base number (TBN) of 4 to 15 mgKOH/g, preferably 5 to 12 mgKOH/g, such as 7 to 11 mgKOH/g, such as 8 to 10 mgKOH/g, as measured by ASTM D2896.

Suitably, the lubricant composition may have:

i) an adhesive wear of 100 hours or more, alternately 120 hours or more, alternately 130 hours or more, alternately 140 hours or more as measured by ASTM D8074-16; and ii) a foam volume at 24° C. of 70 ml or less, alternately 50 ml or less, alternately 30 ml or less, as measured by ASTM D892, option A;

iii) and a foam volume at 93.5° C. of 30 ml or less, alternately 20 ml or less, alternately 10 ml or less, as measured by ASTM D892, option A; and iv) a total base number (TBN) of 4 to 15 mgKOH/g, preferably 5 to 12 mgKOH/g, such as 7 to 11 mgKOH/g, such as 8 to 10 mgKOH/g, as measured by ASTM D2896.

Suitably, the lubricant composition may have a total base number (ASTM D2896) that is at least 5% more (alternately at least 10% more, alternately at least 20% more, alternately at least 50% more) than the TBN amount measured in the same formulation tested under the same conditions except that zinc stearate is used in place of the metal alkanoates represented by Formula (I), e.g., zinc neodecanoate.

Alternately, the lubricant composition may have a total base number (ASTM D2896) that is at least 10% more (alternately at least 20% more, alternately at least 50% more) than the TBN amount measured in the same formulation tested under the same conditions except that the metal alkanoates represented by Formula (I), e.g., zinc neodecanoate is absent.

Suitably, the lubricant composition may have an adhesive wear, as measured by ASTM D8074, that is at least 20% more (alternately at least 30% more, alternately at least 40% more, alternately at least 50% more, alternately at least 60% more, alternately at least 70% more, alternately at least 100% more) than the adhesive wear measured in the same formulation tested under the same conditions except that zinc stearate is used in place of the metal alkanoates represented by Formula (I), e.g., zinc neodecanoate.

Suitably, the lubricant composition may have an adhesive wear, as measured by ASTM D8074, that is at least 20% more (alternately at least 30% more, alternately at least 40% more, alternately at least 50% more, alternately at least 60% more, alternately at least 70% more, alternately at least 100% more) than the adhesive wear measured in the same formulation tested under the same conditions except that the metal alkanoates represented by Formula (I), e.g., zinc neodecanoate is absent.

The lubricating compositions of the present invention may contain low levels of phosphorus, namely not greater than 1600, preferably not greater than 1200, more preferably not greater than 800, such as 1 to 1600, such as 5 to 1200, such as 10 to 800 parts per million (ppm), based on the total mass of the lubricating compositions, as measured by ASTM D5185.

The lubricating compositions of the present invention may contain a ratio of atoms of zinc to atoms of phosphorus, based on the total mass of the lubricating compositions, as measured by ASTM D5185, of 1.2 to 4.8, alternatively 2.0 to 4.5, preferably 2.5 to 4.0.

Typically, the lubricating compositions may contain low levels of sulfur. Preferably, the lubricating composition contains up to 0.4, more preferably up to 0.3, most preferably up to 0.2, such as 0.1 to 0.4 mass % sulfur, based on the total mass of the lubricating composition, as measured by ASTM D2622.

Typically, the lubricating compositions may contain low levels of sulfated ash, such as 1.0 mass % or less, preferably 0.8 or less mass %, preferably 0.5 or less mass %, alternately 0.001 to 0.5 mass % sulfated ash, based on the total mass of the lubricating composition, as measured by ASTM D874.

Generally, the kinematic viscosity at 100° C. ("KV100") of the lubricating composition ranges from 2 to 30 cSt, such as 2 to 20 cSt, such as 5 to 15 cSt (as determined according to ASTM D445-19a).

Generally, the total base number of the lubricating composition ranges from 1 to 30, such as 5 to 15 mgKOH/g (as determined according to ASTM D2896).

Generally, the high temperature high shear viscosity (HTHS) at 150° C. and 1.0×106 s-1 shear rate, of the lubricating composition is from 0.5 to 20, such as 1 to 10 cP, such as 2 to 4 cP (as determined according to ASTM D4683-20).

Preferably, the lubricating composition of the present invention is a multigrade oil identified by the viscometric descriptor SAE 20W-X, SAE 15W-X, SAE 10W-X, SAE 5W-X or SAE 0W-X, where X represents any one of 8, 12, 16, 20, 30, 40 and 50; the characteristics of the different viscometric grades can be found in the SAE J300 classification. The lubricating composition is preferably in the form of an SAE 10W-X, SAE 5W-X, or SAE 0W-X, more preferably in the form of a SAE 5W-X or SAE 0W-X, wherein X represents any one of 8, 12, 16, 20, 30, 40, and 50. Preferably X is 8, 12, 16, or 20. (See standard SAE J300 published by SAE International, formerly known as Society of Automotive Engineers.)

A. Base Oil

The base oil (also referred to as "base stock," "lubricating oil basestock," or "oil of lubricating viscosity") useful herein may be a single oil or a blend of oils, and is typically a large liquid constituent of a lubricating composition, also referred to as a lubricant, into which additives and optional additional oils are blended, for example to produce a lubricating composition, such as a final lubricant composition, a concentrate, or other lubricating composition.

A base oil may be selected from vegetable, animal, mineral, and synthetic lubricating oils, and mixtures thereof. It may range in viscosity from light distillate mineral oils to heavy lubricating oils such as gas engine oil, mineral lubricating oil, motor vehicle oil and heavy-duty diesel oil. Generally, the kinematic viscosity at 100° C. ("KV100") of the base oil ranges from 2 to 30, especially 5 to 20 cSt (as determined according to ASTM D445-19a). Generally, the high temperature high shear (HTHS) viscosity at 150° C. and 1.0×106 s-1 shear rate of the base oil ranges from 0.5 to 20 cP, such as 1 to 10 cP, such as 2 to 5 cP (as determined according to ASTM D4683-20).

Typically, when lubricating oil basestock(s) is used to make a concentrate, it may advantageously be present in a concentrate-forming amount to give a concentrate containing, from 1 to 99 wt %, from 5 wt % to 80 wt %, from 10 wt % to 70 wt %, or from 5 wt % to 50 wt % of active ingredient, based upon the weight of the concentrate.

Common oils useful as base oils include animal and vegetable oils (e.g., castor and lard oil), liquid petroleum oils, and hydrorefined and/or solvent-treated mineral lubricating oils of the paraffinic, naphthenic, and mixed paraffinic-naphthenic types. Oils derived from coal or shale are also useful base oils. Base stocks may be manufactured using a variety of different processes including, but not limited to, distillation, solvent refining, hydrogen processing, oligomerization, esterification, and re-refining.

Synthetic lubricating oils useful herein as base oils include hydrocarbon oils such as homopolymerized and copolymerized olefins, referred to as polyalphaolefins or PAO's or group IV base oils [according to the API EOLCS 1509 definition (American Petroleum Institute Publication 1509, see section E.1.3, 19th edition, January 2021, www.API.org)]. Examples of PAO's useful as base oils include: poly(ethylenes), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or $C_{12}$ alkenes, $C_8/C_{10}$ copolymers, $C_8/C_{10}/C_{12}$ copolymers, and $C_{10}/C_{12}$ copolymers, and the derivatives, analogues, and homologues thereof.

In another embodiment, the base oil comprises polyalphaolefins comprising oligomers of linear olefins having 6 to 14 carbon atoms, more preferably 8 to 12 carbon atoms, more preferably 10 carbon atoms having a Kinematic viscosity at 100° C. of 10 or more (as measured by ASTM D445); and preferably having a viscosity index ("VI"), as determined by ASTM D2270, of 100 or more, preferably 110 or more, more preferably 120 or more, more preferably 130 or more, more preferably 140 or more; and/or having a pour point of −5° C. or less (as determined by ASTM D97), more preferably −10° C. or less, more preferably −20° C. or less.

In another embodiment, polyalphaolefin oligomers useful in the present invention comprise $C_{20}$ to $C_{1500}$ paraffins, preferably $C_{40}$ to $C_{1000}$ paraffins, preferably $C_{50}$ to $C_{750}$ paraffins, preferably $C_{50}$ to $C_{500}$ paraffins. The PAO oligomers are dimers, trimers, tetramers, pentamers, etc., of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene, and 1-dodecene. In one embodiment, the olefin is 1-decene, and the PAO is a mixture of dimers, trimers, tetramers, and pentamers (and higher) of 1-decene. Useful PAO's are described more particularly in, for example, U.S. Pat. Nos. 5,171,908 and 5,783,531, and in Synthetic Lubricants and High-Performance Functional Fluids 1-52 (Leslie R. Rudnick & Ronald L. Shubkin, ed. Marcel Dekker, Inc. 1999).

PAO's useful in the present invention typically possess a number average molecular weight of from 100 to 21,000 g/mol in one embodiment, and from 200 to 10,000 g/mol in another embodiment, and from 200 to 7,000 g/mol in yet another embodiment, and from 200 to 2,000 g/mol in yet another embodiment, and from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn PAO's from Ineos Oligomers USA LLC.

Synthetic lubricating oils useful as base oils also include hydrocarbon oils such as homopolymerized and copolymerized: alkylbenzenes [e.g., dodecylbenzenes, tetradecylbenzenes, dinonylbenzenes, di(2-ethylhexyl)benzenes]; polyphenols (e.g., biphenyls, terphenyls, alkylated polyphenols); and alkylated diphenyl ethers and alkylated diphenyl sulfides; and the derivatives, analogues, and homologues thereof.

Another suitable class of synthetic lubricating oils useful as base oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol, and tripentaerythritol.

Desirable ester base oils are commercially available as Esterex™ Esters (ExxonMobil Chemical Company, Houston Texas).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)-siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the lubricating compositions of the present invention. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. A re-refined base oil is preferably substantially free from materials introduced through manufacturing, contamination, or previous use.

Other examples of useful base oils are gas-to-liquid ("GTL") base oils, i.e., the base oil is an oil derived from hydrocarbons made from synthesis gas ("syn gas") containing H2 and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. For further information on useful GTL base oils and blends thereof, please see U.S. Pat. No. 10,913,916 (column 4, line 62 to column 5, line 60) and 10,781,397 (column 14, line 54 to column 15, line 5, and column 16, line 44 to column 17, line 55).

The various base oils are often categorized as Group I, II, III, IV, or V according to the API EOLCS 1509 definition (American Petroleum Institute Publication 1509, see section E.1.3, 19th edition, January 2021, www.API.org). Generally speaking, Group I base stocks have a viscosity index of between about 80 to 120 and contain greater than about 0.03% sulfur and/or less than about 90% saturates. Group II base stocks have a viscosity index of between about 80 to 120 and contain less than or equal to about 0.03% sulfur and greater than or equal to about 90% saturates. Group III base stocks have a viscosity index greater than about 120 and contain less than or equal to about 0.03% sulfur and greater than about 90% saturates. Group IV base stocks include polyalphaolefins (PAO). Group V base stocks include base stocks not included in Groups I-IV. (Viscosity index measured by ASTM D2270, saturates is measured by ASTM D2007, and sulfur is measured by ASTM D2622, ASTM D4294, ASTM D4927, and ASTM D3120).

Base oils for use in the formulated lubricating compositions useful in the present disclosure are any one, two, three, or more of the variety of oils described herein. In desirable embodiments, base oils for use in the formulated lubricating compositions useful in the present disclosure are those described as API Group I, Group II, Group III (including Group III+), Group IV, and Group V oils and mixtures thereof, preferably API Group II, Group III, Group IV, and Group V oils and mixtures thereof, more preferably the Group III, Group III+, IV and Group V base oils due to their exceptional volatility, stability, viscometric and cleanliness features. Minor quantities of Group I basestock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is more useful that the Group II base stock be in the higher quality range associated with that stock, i.e., a Group II stock having a viscosity index in the range from 100 to 120.

The base oil useful herein may be selected from any of the synthetic, natural, or re-refined oils (such as those typically used as crankcase lubricating oils for spark-ignited and compression-ignited engines). Mixtures of synthetic and/or natural and/or re-refined base oils may be used if desired. Multi-modal mixtures (such as bi- or tri-modal mixtures) of Group I, II, III, IV, and/or V base stocks may be used if desired.

The base oil or base oil blend used herein conveniently has a kinematic viscosity at 100° C. [KV100, as measured according to ASTM D445-19a, and reported in units of centistoke (cSt) or its equivalent, mm2/s], of about 2 to about 40 cSt, alternately of 3 to 30 cSt, alternately 4 to 20 cSt at 100° C., alternately 5 to 10 cSt, alternately the base oil or base oil blend may have a kinematic viscosity at 100° C. of 2 to 20 cSt, of 2.5 to 2 cSt, and preferably of about 2.5 cSt to about 9 cSt.

The base oil or base oil blend preferably has a saturate content of at least 65 mass %, more preferably at least 75 mass %, such as at least 85 mass %, such as greater than 90 mass % as determined by ASTM D2007.

Preferably, the base oil or base oil blend will have a sulfur content of less than 1 mass %, preferably less than 0.6 mass %, most preferably less than 0.4 mass %, such as less than 0.3 mass %, based on the total mass of the lubricating composition, as measured by ASTM D2622.

In embodiments, the volatility of the base oil or base oil blend, as measured by the Noack test (ASTM D5800, procedure B), is less than or equal to 30 mass %, such as less than or equal to 25 mass %, such as less than or equal to 20 mass %, such as less than or equal to 16 mass %, such as less than or equal to 12 mass %, such as less than or equal to 10 mass %, based on the total mass of the lubricating composition.

In embodiments, the viscosity index (VI) of the base oil is at least 95, preferably at least 110, more preferably at least 120, even more preferably at least 125, most preferably from about 130 to 240, in particular from about 105 to 140 (as determined by ASTM D2270).

The base oil may be provided in a major amount, in combination with a minor amount of one or more additive components as described hereinafter, constituting a lubricant. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base oil may be provided in a minor amount, in combination with minor amounts of one or more additive components as described hereinafter, constituting an additive concentrate. This preparation may be accomplished by adding the additives directly to the oil or by adding the one or more additives in the form of a solution, slurry, or suspension thereof to disperse or dissolve the additive(s) in the oil. Additives may be added to the oil by any method known to those skilled in the art, either before, at the same time as, or after addition of other additives.

The base oil typically constitutes the major component of an engine oil lubricant composition of the present disclosure and typically is present in an amount ranging from about 50 to about 99 wt %, preferably from about 70 to about 95 wt %, and more preferably from about 80 to about 95 wt %, based on the total weight of the composition.

Typically, one or more base oils are present in the lubricating composition in an amount of 32 wt % or more, alternately 55 wt % or more, alternately 60 wt % or more, alternately 65 wt % or more, based on the total weight of the lubricating composition. Typically, one or more base oils are present in the lubricating composition at an amount of 98 wt % or less, more preferably 95 wt % or less, even more preferably 90 wt % or less. Alternately, one or more base oils are present in the lubricating composition at from 1 to 99 mass %, alternately 50 to 97 mass %, alternately to 60 to 95 mass %, alternately 70 to 95 mass %, based upon the weight of the lubricating composition.

This invention also relates to lubricating oil compositions comprising or resulting from the admixing of the functionalized hydrogenated/saturated polymers described herein and at least 40 wt % hydrocarbon basestock oil, such as Group I, II, and/or III oil, such as a group II or III oil.

This invention also relates to additive concentrates comprising or resulting from the admixing of the functionalized hydrogenated/saturated polymers described herein and at least 1 wt % hydrocarbon basestock oil, such as Group I, II, and/or III oil, such as a group I or II oil.

The base oils and blends thereof described above are also useful for making concentrates, as well as for making lubricants therefrom.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (also referred to as an "adpack") comprising one or more co-additives, such as described hereinafter, in a single concentrate.

A concentrate, also referred to as an additive package or adpack, is a composition typically having less than 50 mass % (such as less than 40%, such as less than 30 mass %, such as less than 25%, such as less than 20%) base oil which is typically then further blended with further base oil and other components, such as viscosity modifiers and pour point depresants to form a lubricating oil product.

This invention relates to concentrate compositions comprising or resulting from the admixing of:

(i) from 1 to less than 50 mass % (alternately 5 to 45 mass %, alternately 7 to 40 mass %, alternately 10 to 35 mass %, alternately 10 to 25 mass %), based upon the weight of the composition, of one or more base oil(s);

(ii) from 0.10 to 20 mass % (in particular 0.15 to 10 mass %, alternately 0.20 mass % to 5 mass %, alternately 0.25 to 2 mass %), based upon the weight of the composition, of one or more detergent(s);

(iii) from 0.10 to 20 mass % (in particular 0.15 to 10 mass %, alternately 0.20 mass % to 5 mass %, alternately 0.25 to 2 mass %), based upon the weight of the composition, of one or more dispersant(s) (such as PIBSA-PAM); and (iv) from 0.10 to 20 mass % (in particular 0.15 to 10 mass %, alternately 0.20 mass % to 5 mass %, alternately 0.25 to 2 mass %), based upon the weight of the composition, of one or more of one or more metal alkanoates represented by the Formula (I):

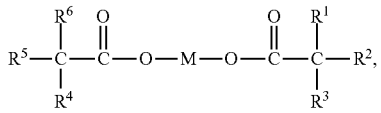

(I)

where, M is a group 4, 5, 10, 11, 12, or 13 metal, such as gold, silver, palladium, platinum, zirconium, vanadium, nickel, copper, zinc, aluminum or mixtures of 2, 3, 4, 5, 6, 7, or 8 metals, such as 2 or 3 of zinc, nickel, copper, and aluminum, or such as zinc, preferably M is not a group 4 metal, such as Ti, Zr, or Hf; and each of $R^1$, $R^2$, and $R^3$ is hydrogen or a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, each of $R^4$, $R^5$ and $R^6$ is, independently, a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, where $R^1+R^2+R^3$=7 or more carbon atoms, i.e., the sum of the number of carbon atoms in $R^1$, $R^2$, and $R^3$ is 7 or more carbon atoms (alternately from 7 to 40, alternately from 8 to 22, alternately 7, 8, 9, 10, 11, 12, 13, or 14 carbon atoms) and $R^4+R^5+R^6$=7 or more carbon atoms, i.e., the sum of the number of carbon atoms in $R^4$, $R^5$, and $R^6$ is 7 or more carbon atoms (alternately from 7 to 40, alternately from 8 to 22, alternately 7 to 20, alternately 7, 8, 9, 10, 11, 12, 13, or 14 carbon atoms):

(v) optional additional components, anti-oxidants, pour point depressants, anti-foam agents, viscosity modifiers, corrosion inhibitors, anti-wear agents, extreme pressure additives, demulsifiers, seal compatibility agents, additive diluent base oils, friction modifier(s) (such as organic FM, such as organic ester, such as fatty acid ester), acid scavengers, etc.

B. Metal Alkanoates

In the metal alkanoates of the invention the quaternary carbon is found at the 2 position in the alkanoate chain, with the carboxylate carbon being at the 1 position. With metal alkanoates having two alkanoate chains, the respective quaternary carbons can be designated 2 and 2' to differentiate them. Useful metal alkanoates include those having branched hydrocarbons, preferably saturated hydrocarbons, attached to the carboxylate functionality via a quaternary carbon. For example, metal alkanoates useful herein include those represented by the Formula (I):

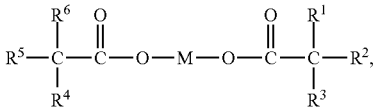

(I)

where, M is a group 4, 5, 10, 11, or 12 metal, such as nickel, palladium, platinum, copper, silver, gold, zinc, tin, zirconium, hafnium, titanium, vanadium, niobium, tantalum, or mixtures of 2, 3, 4, 5, 6, 7, or more group 4, 5, 10, 11, and 12 metals, preferably M is zirconium, vanadium, or zinc, preferably M is zinc (alternately M is not a group 4 metal, such as Ti, Zr, or Hf, alternately M is not Ti);

each of $R^1$, $R^2$, and $R^3$ is, independently, hydrogen or a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, where 3, 2, 1, or none of $R^1$, $R^2$, and $R^3$ are hydrogen, each of $R^4$, $R^5$, and $R^6$ is, independently, a $C_1$ to $C_{20}$ (alternately $C_1$ to $C_{10}$, alternately $C_1$ to $C_6$, alternately $C_2$ to $C_4$) linear, branched, or cyclic alkyl group, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof, and where $R^1+R^2+R^3$=7 or more carbon atoms, i.e., the sum of the number of carbon atoms in $R^1$, $R^2$, and $R^3$ is 7 or more carbon atoms (alternately from 7 to 40, alternately from 8 to 22, alternately 7, 8, 9, 10, 11, 12, 13, or 14 carbon atoms); and $R^4+R^5+R^6$=7 or more carbon atoms, i.e., the sum of the number of carbon atoms in $R^4$, $R^5$, and $R^6$ is 7 or more carbon atoms (alternately from 7 to 40, alternately from 8 to 22, alternately 7, 8, 9, 10, 11, 12, 13, or 14 carbon atoms), and where the lubricant has an adhesive wear of 100 hours or more (as determined by ASTM D8074-16), and optionally a foam volume of 70 ml or less at 24° C. and a foam volume of 50 ml or less at 93.5° C. (as determined by ASTM D 892, option A), and optionally a total base number of 7 mgKOH/g or more (as determined by ASTM D2896).

$R^1+R^2+R^3$ and $R^4+R^5+R^6$ may be the same or different and are independently 7 or more carbon atoms, such as 7, 8, 9, 10, 11, 12, 13, 14, 15, 16, 17, 18, 19, 20, 21, 22, 23, 24, 25, 26, 27, 28, 29, or 30 carbon atoms, in particular 10, 11, 12, 13, 14, 15, 16, 17, 18, 19, or 20 carbon atoms.

In particular, $R^1$, $R^2$, and $R^3$ are derived from one or more neo acids; and $R^4$, $R^5$, and $R^6$ are derived from the same or different neo acids (such as neodecanoic acid, neoundecanoic acid, neododecanoic acid, neotridecanoic acid, neotetradecanoic acid, neopentadecanoic acid, neohexadecanoic acid, neoheptadecanoic acid, neooctadecanoic acid, neononadecanoic acid, neoeicosanoic acid, and isomers thereof).

In particular, useful metal alkanoates include, but are not limited to, those prepared with one or more neo acids such as neodecanoic acid, neoundecanoic acid, neododecanoic acid, neotridecanoic acid, neotetradecanoic acid, neopentadecanoic acid, neohexadecanoic acid, neoheptadecanoic acid, neooctadecanoic acid, neononadecanoic acid, neoeicosanoic acid and any isomers thereof.

In particular, useful metal alkanoates can be a neodecanoate and/or an ethylhexanoate.

In particular, useful metal alkanoates are liquid at 24° C. and are preferably liquid at 60° C. In particular, useful metal alkanoates are preferably liquid at engine start up temperatures, such as −32° C. or more, such as, 0° C. or more, such as 30° C. or more, such as 40° C. or more, such as 60° C. or more, such as −30° C. to 60° C., such as 0 to less than 80° C. and liquid at engine operating temperatures, such as 80° C. or more, such as 150° C. or more, such as 200° C. or more. In embodiments, the metal alkanoate is liquid at −15° C. and liquid at 80° C.

In particular, useful metal alkanoates have a melting point of less than 0° C., preferably less than −10° C., alternately less than −15° C.

In particular, desirable metal alkanoates include, metal neodecanoate, metal neoundecanoate, metal neododecanoate, metal neotridecanoate, metal neotetradecanoate, metal neopentadecanoate, metal neohexadecanoate, metal neoheptadecanoate, metal neooctadecanoiate, metal neononadecanoate, metal neoeicosanoate, and isomers thereof, where the metals are selected from group 4, 5, 10, 11, or 12 metals, such as nickel, palladium, platinum, copper, silver, gold, zinc, tin, zirconium, hafnium, vanadium, niobium, tantalum, or mixtures of 2, 3, 4, 5, 6, or 7 group 4, 5, 10, 11, or 12 metals, such as zinc, vanadium and/or zirconium, preferably the metal is zinc (alternately M is not a group 4 metal, such as Ti, Zr, or Hf).

Particularly desirable metal alkanoates include zinc alkanoates, such as $C_{18}$ to $C_{60}$ zinc neoalkanoates (alternately $C_{20}$ to $C_{40}$ zinc neoalkanoates), such as zinc neodecanoate, zinc neoundecanoate, zinc neododecanoate, zinc neotridecanoate, zinc neotetradecanoate, zinc neopentadecanoate, zinc neohexadecanoate, zinc neoheptadecanoate, zinc neooctadecanoate, zinc neononadecanoate, zinc neoeicosanoate, and isomers therof.

In particular, useful zinc alkanoates are liquid at 24° C. and are preferably liquid at 60° C. In particular, useful zinc alkanoates are preferably liquid at engine start-up temperatures, such as 0° C. or more, such as 30° C. or more, such as 60° C. or more and at liquid at engine operating temperatures, such as 80° C. or more, such as 150° C. or more, such as 200° C. or more.

In particular, useful zinc alkanoates have a melting point of less than 0° C., preferably less than −10° C., alternately less than −15° C.

The lubricating compositions herein may generally comprise from 0.1 to 10 mass %, alternately, 0.2 to 5 mass %, alternately 0.3 to 2.5 mass %, alternately 0.4 to 1.2 mass %, preferably 0.5 to 1 mass % of one or more metal alkanoate compounds as described herein, based on total weight of the lubricating composition.

The metal alkanoate(s) can be included in the lubricating composition of the present invention as an individual component or as part of a concentrate, such as an additive package, together with other additive components. The concentrate (such as additive package) compositions herein may generally comprise from 0.1 to 10 mass %, alternately, 0.2 to 5 mass %, alternately 0.3 to 2.5 mass %, alternately 0.4 to 1.2 mass %, preferably 0.5 to 1 mass % of one or more metal alkanoate compounds as described herein, based on total weight of the concentrate composition.

Illustrative metal alkanoates additives that can be used in addition to those described in Formula (I), include Group 10, 11, and 12 metal salts of a carboxylic acid, where the metal is selected from zinc, nickel, palladium, platinum, copper, silver, gold, tin, and mixtures thereof; and the carboxylic acid is selected from linear, branched, or cyclic aliphatic carboxylic acids, and aromatic carboxylic acids, and mixtures thereof, optionally having from about 8 to about 26 carbon atoms, and mixtures thereof, where the branched aliphatic carboxylic acids preferably do not have a quaternary carbon atom at the 2 position.

Alternately, the metal alkanoate comprises a metal salt of alkyl neo-monocarboxylic acid having a total number of from 5 to 30 carbon atoms (such as 6 to 26 carbon atoms, such as 5 to 20 carbon atoms, such as 7 to 20 carbon atoms, such as 8 to 20 carbon atoms), wherein the metal is as defined for M in Formula (I) herein (and is preferably one or more Group 12 metals, such as zinc) and the alkyl is one or more $C_2$ to $C_{30}$ (such as $C_5$ to $C_{27}$, such as $C_5$ to $C_{20}$) linear, branched or cyclic alkyls (such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, or any isomer thereof); and optionally, when the metal alkanoate (such as zinc neodecanoate) is combined with a phosphorus containing component (such as ZDDP) in a lubricating oil composition, the metal is present in an effective minor to provide a metal (such as zinc) to phosphorus ratio of 1.1 to 4.8 (such as 1.1 to 4.7, or 1.2 to 4.7, or 1.3 to 4.5, or 2.5 to 4.0, or 3.0 to 3.5, or 3.0 to 3.4) by wt %.

Alternately, Group 10, 11, or 12 metal salts of linear or cyclic aliphatic carboxylic acids and aromatic carboxylic acids, and mixtures thereof, such as an aliphatic, saturated, linear carboxylic acid having from about 8 to about 26 carbon atoms, and mixtures thereof, are absent from the compositions of this invention.

Alternately, Group 10, 11, or 12 metal salts of branched carboxylic acids, optionally having from about 8 to about 26 carbon atoms, and mixtures thereof, where the branched aliphatic carboxylic acids do not have a quaternary carbon atom at the 2 position are absent from the compositions of this invention.

Alternately, Group 10, 11, or 12 metal salts of linear or cyclic aliphatic carboxylic acids and aromatic carboxylic acids, and mixtures thereof, such as an aliphatic, saturated, linear carboxylic acid having from about 8 to about 26 carbon atoms, and mixtures thereof are absent from the compositions of this invention; and Group 10, 11, or 12 metal salts of branched carboxylic acids, optionally having from about 8 to about 26 carbon atoms, and mixtures thereof where the branched aliphatic carboxylic acids do not have a quaternary carbon atom at the 2 position are absent from the compositions of this invention.

Alternately Group 10, 11, and 12 metal salts of linear, branched, or cyclic carboxylic acids selected from caprylic acid ($C_5$), pelargonic acid ($C_9$), capric acid ($C_{10}$), undecylic acid ($C_{11}$), lauric acid ($C_{12}$), tridecylic acid ($C_{13}$), myristic acid ($C_{14}$), pentadecylic acid ($C_{15}$), palmitic acid ($C_{16}$), margaric acid ($C_{17}$), isostearic acid ($C_{18}$), stearic acid ($C_{18}$), nonadecylic acid ($C_{19}$), arachidic acid ($C_{20}$), heneicosylic acid ($C_{21}$), behenic acid ($C_{22}$), tricosylic acid ($C_{23}$), lignoceric acid ($C_{24}$), pentacosylic acid ($C_{25}$), cerotic acid ($C_{26}$), naphthenic acid, and mixtures thereof, where the branched aliphatic carboxylic acids do not have a quaternary carbon atom at the 2 position are absent from the compositions of this invention.

In embodiments, the metal alkanoates herein are molecular acids of the form ML2.

Alternately, one or more metal stearate, such as zinc stearate, silver stearate, palladium stearate, zinc palmitate, silver palmitate, and palladium palmitate, are absent from compositions of this invention.

Alternately, zinc stearate, zinc undecylenate, zinc oleate, zinc naphthenate and zinc 2-ethylhexanoate are absent from compositions of this invention.

Alternately, titanium neodecanoate is absent from compositions of this invention.

The lubricating composition according to the present invention may further comprise one or more additives such as detergents, friction modifiers, anti-oxidants, pour point depressants, anti-foam agents, viscosity modifiers, dispersants, corrosion inhibitors, anti-wear agents, extreme pressure additives, demulsifiers, seal compatibility agents, additive diluent base oils, etc. Specific examples of such additives are described in, for example, Kirk-Othmer Encyclopedia of Chemical Technology, third edition, volume 14, pages 477-526, and several are discussed in further detail below.

C. Detergents

The lubricating composition may comprise one or more metal detergents (such as blends of metal detergents) also referred to as a "detergent additive." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mgKOH/g, such as from 0 to 80 (or 5-30) mgKOH/g. A large amount of a metal base may be incorporated by reacting excess metal compound (e.g., an oxide or hydroxide) with an acidic gas (e.g., carbon dioxide). Such detergents, sometimes referred to as overbased, may have a TBN of 100 mgKOH/g or more (such as 200 mgKOH/g or more), and typically will have a TBN of 250 mgKOH/g or more, such as 300 mgKOH/g or more, such as from 200 to 800 mgKOH/g, 225 to 700 mgKOH/g, 250 to 650 mgKOH/g, or 300 to 600 mgKOH/g, such as 150 to 650 mgKOH/g.

Suitable detergents include, oil-soluble neutral and overbased sulfonates, phenates, sulfurized phenates, thiophosphonates, salicylates, naphthenates, and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba), particularly, sodium, potassium, lithium, calcium, and magnesium, such as Ca and or Mg. Furthermore, the detergent may comprise hybrid detergent comprising any combination of sodium, potassium, lithium, calcium, or magnesium salts of sulfonates, phenates, sulfurized phenates, thiophosphonates, salicylates, and naphthenates or other oil-soluble carboxylates of a Group 1 and/or 2 metal.

Preferably, the detergent additive(s) useful in the present invention comprises calcium and/or magnesium metal salts. The detergent may be a calcium and or magensium carboxylate (e.g., salicylates), sulfonate, or phenate detergent. More preferably, the detergent additives are selected from magnesium salicylate, calcium salicylate, magnesium sulfonate, calcium sulfonate, magnesium phenate, calcium phenate, and hybrid detergents comprising two, three, four, or more of more of these detergents and/or combinations thereof.

The metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/-salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The overbased metal-containing detergent may be sodium salts, calcium salts, magnesium salts, or mixtures thereof of the phenates, sulfur-containing phenates, sulfonates, salixarates, and salicylates. Overbased phenates and salicylates typically have a total base number of 180 to 650 mgKOH/g, such as 200 to 450 TBN mgKOH/g. Overbased sulfonates typically have a total base number of 250 to 600 mgKOH/g, or 300 to 500 mgKOH/g. In embodiments, the sulfonate detergent may be predominantly a linear alkylbenzene sulfonate detergent having a metal ratio of at least 8 as is described in paragraphs [0026] to [0037] of U.S. 2005/065045 (and granted as U.S. Pat. No. 7,407,919). The overbased detergent may be present at 0 wt % to 15 wt %, or 0.1 wt % to 10 wt %, or 0.2 wt % to 8 wt %, or 0.2 wt % to 3 wt %, based upon the lubricating composition. For example, in a heavy-duty diesel engine, the detergent may be present at 2 wt % to 3 wt % of the lubricating composition. For a passenger car engine, the detergent may be present at 0.2 wt % to 1 wt % of the lubricating composition.

The detergent additive(s) may comprise one or more magnesium sulfonate detergents. The magnesium detergent may be a neutral salt or an overbased salt. Suitably the magnesium detergent is an overbased magnesium sulfonate having a TBN of from 80 to 650 mgKOH/g (ASTM D2896), such as 200 to 500 mgKOH/g, such as 240 to 450 mgKOH/g.

Alternately, the detergent additive(s) is a magnesium salicylate. Suitably the magnesium detergent is a magnesium salicylate having a TBN of from 30 to 650 mgKOH/g (ASTM D2896), such as 50 to 500 mgKOH/g, such as 200 to 500 mgKOH/g, such as 240 to 450 mgKOH/g or alternately of 150 mgKOH/g or less, such as 100 mgKOH/g or less.

Alternately, the detergent additive(s) is a combination of magnesium salicylate and magnesium sulfonate.

The magnesium detergent provides the lubricating composition thereof with from 200-4000 ppm of magnesium atoms, suitably from 200-2000 ppm, from 300 to 1500 ppm or from 450-1200 ppm of magnesium atoms (ASTM D5185).

The detergent composition may comprise (or consist of) a combination of one or more magnesium sulfonate detergents and one or more calcium salicylate detergents.

The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 or from 450-1200 ppm of magnesium atoms (ASTM D5185), and 2) at least 500 ppm, preferably at least 750, more preferably at least 900 ppm of atomic calcium, such as from 500-4000 ppm, preferably from 750-3000 ppm, more preferably from 900-2000 ppm atomic calcium (ASTM D5185).

The detergent may comprise one or more calcium detergents such as calcium carboxylate (e.g., salicylate), sulfonate, or phenate detergent.

Suitably, the calcium detergent has a TBN of from 30 to 700 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Suitably, the calcium detergent is a calcium salicylate, sulfonate, or phenate having a TBN of from 30 to 700 mgKOH/g, 30 to 650 mgKOH/g (ASTM D2896), such as 50 to 650 mgKOH/g, such as 200 to 500 mgKOH/g, such as 240 to 450 mgKOH/g or alternately of 150 mgKOH/g or less, such as 100 mgKOH/g or less, or 200 mgKOH/g or more, or 300 mgKOH/g or more, or 350 mgKOH/g or more.

Calcium detergent is typically present in an amount sufficient to provide at least 500 ppm, preferably at least 750, more preferably at least 900 ppm atomic calcium to the lubricating oil composition (ASTM D5185). If present, any calcium detergent is suitably present in an amount sufficient to provide no more than 4000 ppm, preferably no more than 3000, more preferably no more than 2000 ppm atomic calcium to the lubricating oil composition (ASTM D5185). If present, any calcium detergent is suitably present in an amount sufficient to provide at from 500-4000 ppm, preferably from 750-3000 ppm, more preferably from 900-2000 ppm atomic calcium to the lubricating oil composition (ASTM D5185).

Suitably, the total atomic amount of metal from detergent in the lubrication composition according to all aspects of the invention is no more than 5000 ppm, preferably no more than 4000 ppm, and more preferably no more than 2000 ppm (ASTM D5185). The total amount of atomic metal from detergent in the lubrication oil composition according to all aspects of the invention is suitably at least 500 ppm, preferably at least 800 ppm, and more preferably at least 1000 ppm (ASTM D5185). The total amount of atomic metal from detergent in the lubrication oil composition according to all aspects of the invention is suitably from 500 to 5000 ppm, preferably from 500 to 3000 ppm, and more preferably from 500 to 2000 ppm (ASTM D5185).

Sulfonate detergents may be prepared from sulfonic acids which are typically obtained by the sulfonation of alkyl-substituted aromatic hydrocarbons such as those obtained from the fractionation of petroleum or by the alkylation of aromatic hydrocarbons. Examples include those obtained by alkylating benzene, toluene, xylene, naphthalene, diphenyl, or their halogen derivatives such as chlorobenzene, chlorotoluene, and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylates, sulfides, hydrosulfides, nitrates, borates, and ethers of the metal. The amount of metal compound is chosen having regard to the desired TBN of the final product, but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur-containing compound, such as hydrogen sulfide, sulfur monohalide or sulfur dihalide, to form products which are generally mixtures of compounds in which 2 or more phenols are bridged by sulfur-containing bridges.

Carboxylate detergents, e.g., salicylates, can be prepared by reacting an aromatic carboxylic acid (such as a $C_{5-100}$, $C_{9-30}$, $C_{14-24}$ alkyl-substituted hydroxy-benzoic acid) with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example, benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In embodiments, the ratio of atomic detergent metal to atomic molybdenum in the lubricating oil composition may be less than 3:1, such as less than 2:1.

Further, as metal organic and inorganic base salts which are used as detergents can contribute to the sulfated ash content of a lubricating oil composition, in embodiments of the present invention, the amounts of such additives are minimized. In order to maintain a low sulfur level, salicylate detergents can be used and the lubricating composition herein may comprise one or more salicylate detergents (said detergents are preferably used in amounts in the range of 0.05 to 20.0 wt %, more preferably from 1.0 to 10.0 wt % and most preferably in the range of from 2.0 to 5.0 wt %, based on the total weight of the lubricating composition).

The total sulfated ash content of the lubricating composition herein is typically not greater than 2.0 wt %, alternately at a level of not greater than 1.0 wt % and alternately at a level of not greater than 0.8 wt %, based on the total weight of the lubricating composition as determined by ASTM D874.

Furthermore, it is useful that each of the detergents, independently, have a TBN (total base number) value in the range of from 10 to 700 mgKOH/g, 10 to 500 mgKOH/g, alternately in the range of from 100 to 650 mgKOH/g, alternately in the range of from 10 to 500 mgKOH/g, alternately in the range of from 30 to 350 mgKOH/g, and alternately in the range of from 50 to 300 mgKOH/g, as measured by ISO 3771.

Typically, lubricating compositions formulated for use in heavy-duty diesel engines comprise detergents at from about 0.5 to about 10 mass %, alternately from about 2.5 to about 7.5 mass %, alternately from about 4 to about 6.5 mass %, based on the lubricating composition.

D. Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricating compositions, or functional fluids, to modify the coefficient of friction of a lubricated surface may be effectively used in combination with the base oils or lubricating compositions of the present disclosure if desired. Friction modifiers that lower the coefficient of friction are particularly advantageous in combination with the base oils and lubricating compositions of this disclosure.

Illustrative friction modifiers may include, for example, organometallic compounds or materials, or mixtures thereof. Illustrative organometallic friction modifiers useful in the lubricating oil formulations of this disclosure include, for example, tungsten and/or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds may conveniently include molybdenum dithiocarbamates, trinuclear molybdenum compounds, for example, as described in WO 98/26030, sulfides of molybdenum and molybdenum dithiophosphate.

Other known friction modifiers comprise oil-soluble organo-molybdenum compounds. Such organo-molybdenum friction modifiers may also provide antioxidant and anti-wear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates, and alkylthioxanthates.

Additionally, the molybdenum compound may be an acidic molybdenum compound. These compounds will react with a basic nitrogen compound as measured by ASTM test D664 or D2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula:

$Mo(R''OCS_2)_4$ and $Mo(R''SCS_2)_4$ wherein, R" is an organo group selected from the group consisting of alkyl, aryl, aralkyl and alkoxyalkyl, generally of from 1 to 30 carbon atoms, and preferably 2 to 12 carbon atoms, and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3SkLnQz$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron-donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Lubricating oil compositions useful in all aspects of the present invention preferably contain at least 10 ppm, at least 30 ppm, at least 40 ppm, and more preferably at least 50 ppm molybdenum. Suitably, lubricating oil compositions useful in all aspects of the present invention contain no more than 1000 ppm, no more than 750 ppm, or no more than 500 ppm of molybdenum. Lubricating oil compositions useful in all aspects of the present invention preferably contain from 10 to 1000, such as 30 to 750, or 40 to 500 ppm of molybdenum (measured as atoms of molybdenum).

For more information or useful friction modifiers containing Mo, please see U.S. Pat. No. 10,829,712 (column 8, line 58 to column 11, line 31).

Ashless friction modifiers may be present in the lubricating oil compositions of the present invention and are known generally and include esters formed by reacting carboxylic acids and anhydrides with alkanols and amine-based friction modifiers. Other useful friction modifiers generally include a polar terminal group (e.g., carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26. Typically, the total amount of organic ashless friction modifier in a lubricant according to the present invention does not exceed 5 mass %, based on the total mass of the lubricating oil composition and preferably does not exceed 2 mass % and more preferably does not exceed 0.5 mass %.

Illustrative friction modifiers useful in the lubricating compositions described herein include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates, and the corresponding glycerol monopalmitates, glycerol dipalmitates, and glycerol tripalmitates, and the respective isostearates, linoleates, and the like. Ethoxylated, propoxylated, butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

Useful concentrations of friction modifiers may range from 0.01 wt % to 5 wt 00 or about 0.1 wt % to about 2.5 wt %, or about 0.1 wt % to about 1.5 wt %, or about 0.1 wt % to about 1 wt %. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable. For example, combinations of Mo containing compounds with polyol fatty acid esters, such as glycerol mono-oleate are useful herein.

E. Antioxidants

Antioxidants retard the oxidative degradation of base oils during service. Such degradation may result in deposits on metal surfaces, the presence of sludge, or a viscosity increase in a lubricant. A wide variety of oxidation inhibitors that are useful in lubricating oil compositions. See Lubricants and Related Products, Klamann, Wiley VCH, 1984; U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic proprionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include, for example 4,4'-bis (2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$, where $R^8$ is an aliphatic, aromatic or substituted aromatic group, $R^9$ is an aromatic or a substituted aromatic group, and $R^{10}$ is H, alkyl, aryl or $R^{11}S(O)XR^{12}$ where $R^{11}$ is an alkylene, alkenylene, or aralkylene group, $R^{12}$ is an alkyl group, or an alkenyl, aryl, or alkaryl group, and x is 0, 1, or 2. The aliphatic group $R^8$ may contain from 1 to about 20 carbon atoms, and preferably contains from about 6 to 12 carbon atoms. The aliphatic group is typically a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amine antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine.

Sulfur containing anti-oxidants are also useful herein. In particular, one or more oil-soluble or oil-dispersible sulfur-containing anti-oxidant(s)can be used as an antioxidant additive. For example, sulfurized alkyl phenols and alkali or alkaline earth metal salts thereof also are useful antioxidants herein. Suitably, the lubricating oil composition(s) of the present invention may include the one or more sulfur-containing anti-oxidant(s) in an amount to provide the lubricating oil composition with from 0.02 to 0.2, preferably from 0.02 to 0.15, even more preferably 0.02 to 0.1, even more preferably 0.04 to 0.1, mass % sulfur based on the total mass of the lubricating oil composition. Optionally the oil-soluble or oil-dispersible sulfur-containing anti-oxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic anti-oxidant(s), sulfur-containing organo-molybdenum compound(s), and combinations thereof. For further information, on sulfurized materials useful as anti-oxidants herein, please see U.S. Pat. No. 10,731,101 (column 15, line 55 to column 22, line 12).

Antioxidants useful herein include hindered phenols and arylamines. These antioxidants may be used individually by type or in combination with one another.

Typical antioxidants include: Irganox™ L67, ETHANOX™ 4702, Lanxess Additin™ RC 7110; ETHANOX™ 4782J; Irganox™ 1135, Irganox™ 5057, sulfurized lard oil and palm oil fatty acid methyl ester.

Antioxidant additives may be used (alone or in combination) in an amount of about 0.01 to 5 wt %, preferably about 0.01 to 3 wt %, more preferably 0.01 to 1.5 wt %, more preferably 0.01 to less than 1 wt %, based upon the weight of the lubricating composition.

Compositions according to the present disclosure may contain an additive having a different enumerated function that also has secondary effects as an antioxidant [for example, phosphorus-containing anti-wear agents (such as ZDDP) may also have antioxidant effects]. These additives are not included as antioxidants for purposes of determining the amount of antioxidant in a lubricating oil composition or concentrate herein.

F. Pour Point Depressants

Conventional pour point depressants (also known as lube oil flow improvers) may be added to the compositions of the present disclosure if desired. These pour point depressants may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

G. Anti-Foam Agents

Anti-foam agents may advantageously be added to lubricant compositions described herein. These agents prevent or retard the formation of stable foams. Silicones and organic polymers are typical anti-foam agents. For example, polysiloxanes, such as silicon oil or polydimethyl siloxane, provide anti-foam properties.

Anti-foam agents are commercially available and may be used in minor amounts such as 5 wt % or less, 3 wt % or less, 1 wt % or less, 0.1 wt % or less, such as from 5 to wt % to 0.1 ppm, such as from 3 wt % to 0.5 ppm, such as from 1 wt % to 10 ppm.

For example, it may be that the lubricating oil composition comprises an anti-foam agent comprising polyalkyl siloxane, such as a polydialkyl siloxane, for example, wherein the alkyl is a $C_1$-$C_{10}$ alkyl group, e.g., a polydimethylsiloxane (PDMS), also known as a silicone oil. Alternately, the siloxane is a poly($R^3$)siloxane, wherein $R^3$ is one or more, same or different, linear branched or cyclic hydrocarbyls, such as alkyls or aryls, typically having 1 to 20 carbon atoms. It may be that, for example, the lubricating oil composition comprises a polymeric siloxane compound according to Formula 1 below wherein $R^1$ and $R^2$ are independently methyl, ethyl, propyl, butyl, pentyl, hexyl, heptyl, octyl, nonyl or decyl, phenyl, naphthyl, alkyl substituted phenyl, or isomers thereof (such as methyl, phenyl) and n is from 50 to 450.

Additionally or alternatively, it may be that the lubricating oil composition comprises an organo modified siloxane (OMS), such as a siloxane modified with an organo group such as a polyether (e.g., ethylene-propyleneoxide copolymer), long chain hydrocarbyl (e.g., $C_{11}$-$C_{100}$ alkyl), or aryl (e.g., $C_6$-$C_{14}$ aryl). It may be that, for example, the lubricating oil composition comprises an organo modified siloxane compound according to Formula 1, wherein n is from 50 to 450, and wherein $R^1$ and $R^2$ are the same or different, optionally wherein each of $R^1$ and $R^2$ is, independently an organo group, such as an organo group selected from polyether (e.g., ethylene-propyleneoxide copolymer), long chain hydrocarbyl (e.g., $C_{11}$-$C_{100}$ alkyl), or aryl (e.g., $C_6$-$C_{14}$ aryl). Preferably, one of $R^1$ and $R^2$ is $CH_3$.

Formula 1

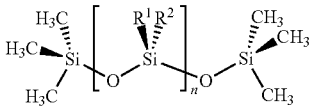

Based on the total weight of the lubricant composition, the siloxane according to Formula I is incorporated so as to provide about 0.1 to less than about 30 ppm Si, or about 0.1 to about 25 ppm Si, or about 0.1 to about 20 ppm Si, or about 0.1 to about 15 ppm Si, or about 0.1 to about 10 ppm Si. More preferably, it is in the range of about 3-10 ppm Si.

In an embodiment, silicone anti-foam agents useful herein are available from Dow Corning Corporation and Union Carbide Corporation, such as Dow Corning FS-1265 (1000 centistokes), Dow Corning DC-200, and Union Carbide UC-L45. Silicone anti-foamants useful herein are polydimethylsiloxane, phenyl-methyl polysiloxane, linear, cyclic or branched siloxanes, silicone polymers and copolymers, and organo-silicone copolymers. Also, a siloxane polyether copolymer anti-foamant available from OSI Specialties, Inc. of Farmington Hills, Mich. and may be substituted or included. One such material is sold as SILWET-L-7220.

Acrylate polymer anti-foam agent can also be used herein. Typical acrylate anti-foamants include polyacrylate anti-foamant available from Monsanto Polymer Products Co. known as PC-1244. A preferred acrylate polymer anti-foam agent useful herein is PX™3841 (i.e., an alkyl acrylate polymer), commercially available from Dorf Ketl, also referred to as Mobilad™C402.

In embodiments, a combination of sililcone anti-foamant and acrylate anti-foamant can be used, such as at a weight ratio of the silicone anti-foamant to the acrylate anti-foamant of from about 5:1 to about 1:5, see, for example, U.S. 2021/0189283A1.

H. Viscosity Modifers

Viscosity modifiers (also referred to as viscosity index improvers or viscosity improvers) can be included in the lubricating compositions described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Typical molecular weights of these polymers are between about 10,000 to 1,500,000 g/mol, more typically about 20,000 to 1,200,000 g/mol, and even more typically between about 50,000 and 1,000,000 g/mol.

Examples of suitable viscosity modifiers are linear or star-shaped polymers and copolymers of methacrylate, butadiene, olefins, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 g/mol molecular weight.

Copolymers useful as viscosity modifiers include those commercially available from Chevron Oronite Company LLC under the trade designation "PARATONE™" (such as "PARATONE™ 8921," PARATONE™ 68231," and "PARATONE™ 8941"); from Afton Chemical Corporation under the trade designation "HiTEC™" (such as HiTEC™ 5850B, and HiTEC™5777); and from The Lubrizol Corporation under the trade designation "Lubrizol™ 7067C". Hydrogenated polyisoprene star polymers useful as viscosity modifiers herein include those commercially available from Infineum International Limited, e.g., under the trade designation "SV200™" and "SV600™". Hydrogenated diene-styrene block copolymers useful as viscosity modifiers herein are commercially available from Infineum International Limited, e.g., under the trade designation "SV 50™".

Polymers useful as viscosity modifiers herein include polymethacrylate or polyacrylate polymers, such as linear polymethacrylate or polyacrylate polymers, such as those available from Evnoik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer (such as isoprene).

Typically, the viscosity modifiers may be used in an amount of about 0.01 to about 10 wt %, such as about 0.1 to about 7 wt %, such as 0.1 to about 4 wt %, such as about 0.2 to about 2 wt %, such as such as about 0.2 to about 1 wt %, and such as about 0.2 to about 0.5 wt %, based on the total weight of the formulated lubricant composition.

In embodiments, the viscosity modifier may be functionalized, such as with one or more amines, imide, esters, alcohols, or the like to form a dispersant viscosity modifier ("DVM"). In embodiments, the lubricating composition of the invention comprises one or more dispersant viscosity modifiers. Suitable dispersant viscosity modifiers include functionalized polyolefins, for example, ethylene-propylene copolymers that have been functionalized with an acylating agent such as maleic anhydride and an amine; polymethacrylates functionalized with an amine, or esterified styrene-maleic anhydride copolymers reacted with an amine. More detailed description of dispersant viscosity modifiers are disclosed in WO 2006/015130 or U.S. Pat. Nos. 4,863,623; 6,107,257; 6,107,258; and 6,117,825. In embodiments, the dispersant viscosity modifier may include those described in U.S. Pat. No. 4,863,623 (see column 2, line 15 to column 3, line 52) or in WO 2006/015130 (see page 2, paragraph [0008] and preparative examples are described at paragraphs [0065] to [0073]). Useful DVM's also include functionalized polymers described in U.S. Ser. No. 63/379,006, filed Oct. 11, 2022, entitled Functionalized $C_{4\ to\ 5}$ Olefin Polymers and Lubricant Compositions Containing Such, including but not limited to amide, imide, ester and/or alcohol functionalized partially or fully saturated polymer comprising $C_{4\ to\ 5}$ olefins having an Mw/Mn of less than 2, a functionality parameter of 1.4 to 15 per 10,000 g/mol and wherein the polymer prior functionalization has an Mn of 30,000 g/mol or more (GPC-polystyrene standards), such as an amine functionalized partially or fully saturated polyisoprene, where GPC-polystyrene standards, Mw/Mn, and functionality parameter are as described in U.S. Ser. No. 63/379,006, filed Oct. 11, 2022 and entitled Functionalized $C_{4\ to\ 5}$ Olefin Polymers and Lubricant Compositions Containing Such, which is incorporated by reference herein. The dispersant viscosity modifier may be present at 0 to 5 mass %, or 0.01 to 4 mass %, or 0.05 to 2 mass % of the lubricating composition.

Viscosity modifiers are typically added as concentrates, in large amounts of diluent oil. The "as delivered" viscosity modifier or dispersant viscosity modifier typically contains from 20 wt % to 75 wt % of an active polymer for polymethacrylate or polyacrylate polymers, or from 8 wt % to 20 wt % of an active polymer for olefin copolymers, hydrogenated polyisoprene star polymers, or hydrogenated diene-styrene block copolymers, in the "as delivered" polymer concentrate.

I. Dispersants

During engine operation, oil-insoluble oxidation byproducts are produced. Dispersants help keep these byproducts in solution, thus diminishing their deposition on metal surfaces. Dispersants used in the formulation of the lubricating compositions herein may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents tend to form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Dispersants of (Poly)Alkenylsuccinic Derivatives

A particularly useful class of dispersants includes the (poly)alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of 400 to 3000 g/mol, such as 450 to 2500 g/mol). Many examples of this type of dispersant are well known commercially and in the literature. Exemplary U.S. patents describing such dispersants include U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; and 5,705,458. A further description of dispersants useful herein may be found, for example, in EP Application 0 471 071 and EP Application 0 451 380, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of with a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 and 4000 g/mol, such as from 800 to 3000 g/mol, such as from 2000 and 2800 g/mol, such from about 2100 to 2500 g/mol, and such as from about 2200 to about 2400 g/mol.

Succinimides, which are particularly useful herein, are formed by the condensation reaction between: 1) hydrocarbyl substituted succinic anhydrides, such as polyisobutylene succinic anhydride (PIBSA); and 2) polyamine (PAM). Examples of suitable polyamines include: polyalkylene polyamines, hydroxy-substituted polyamines, polyoxyalkylene polyamines, and combinations thereof. Examples of polyalkylene polyamines include tetraethylene pentamine, pentaethylene hexamine, tetraethylenepentamine (TEPA), pentaethylenehaxamine (PEHA), n-phenyl-p-phenylenediamine (ADPA), and other polyamines having an average of 5, 6, 7, 8, or 9 nitrogen atoms per molecule). Mixtures where the average number of nitrogen atoms per polyamine molecule is greater than 7 are commonly called heavy polyamines or H-PAMs and may be commercially available under trade names such as HPA™ and HPA-X™ from Dow Chemical, E-100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666; 3,272,746; 3,322,670; 3,652,616; 3,948,800; and 6,821,307; and CA 1,094,044.

Succinate esters useful as dispersants include those formed by the condensation reaction between hydrocarbyl substituted succinic anhydrides and alcohols or polyols. For example, the condensation product of a hydrocarbyl substituted succinic anhydride and pentaerythritol is a useful dispersant.

Succinate ester amides useful herein are formed by a condensation reaction between hydrocarbyl substituted succinic anhydrides and alkanol amines. Suitable alkanol amines include ethoxylated polyalkylpolyamines, propoxylated polyalkylpolyamines, and polyalkenylpolyamines, such as polyethylene polyamines and or propoxylated hexamethylenediamine. Representative examples are shown in U.S. Pat. No. 4,426,305.

Hydrocarbyl substituted succinic anhydrides (such as PIBSA) esters of hydrocarbyl bridged aryloxy alcohols are also useful as dispersants herein. For information on such dispersants, please see U.S. Pat. No. 7,485,603, particularly, column 2, line 65 to column 6, line 22 and column 23, line 40 to column 26, line 46. In particular PIBSA esters of methylene-bridged naphthyloxy ethanol (i.e., 2-hydroxyethyl-1-naphthol ether (or hydroxy-terminated ethylene oxide oligomer ether of naphthol) are useful herein.

The molecular weight of the hydrocarbyl substituted succinic anhydrides used in the preceding paragraphs will typically range from 350 to 4000 g/mol, such as 400 to 3000 g/mol, such as 450 to 2800 g/mol, such as 800 to 2500 g/mol. The above (poly)alkenylsuccinic derivatives can be post-reacted with various reagents such as sulfur, oxygen, formaldehyde, carboxylic acids such as oleic acid.

The dispersant may be present in the lubricant in an amount of 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition.

The above (poly)alkenylsuccinic derivatives, can also be post reacted with boron compounds such as boric acid, borate esters or highly borated dispersants, to form borated dispersants generally having from about 0.1 to about 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 300 to about 5000 g/mol, or from about 500 to about 3000 g/mol, or about 1000 to about 2000 g/mol, or a mixture of such hydrocarbylene groups, often with high terminal vinylic groups.

The boron-containing dispersant may be present at 0.01 wt % to 20 wt %, or 0.1 wt % to 15 wt %, or 0.1 wt % to 10 wt %, or 0.5 wt % to 8 wt %, or 1.0 wt % to 6.5 wt %, or 0.5 wt % to 2.2 wt % of the lubricating composition.

The boron-containing dispersant may be present in an amount to deliver boron to the composition at 15 ppm to 2000 ppm, or 25 ppm to 1000 ppm, or 40 ppm to 600 ppm, or 80 ppm to 350 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be 0.01 wt % to 20 wt %, or 0.1 wt % to 15 wt %, or 0.1 wt % to 10 wt %, or 0.5 wt % to 8 wt %, or 1.0 wt % to 6.5 wt %, or 0.5 wt % to 2.2 wt % of the lubricating composition and wherein the ratio of borated dispersant to non-borated dispersant may be 1:10 to 10:1 (weight:weight) or 1:5 to 3:1 or 1:3 to 2:1.

Dispersants of Mannich Bases

Mannich base dispersants useful herein are typically made from the reaction of an amine component, a hydroxy aromatic compound (substituted or unsubstituted, such as alkyl substituted), such as alkylphenols, and an aldehyde, such as formaldehyde. See U.S. Pat. Nos. 4,767,551 and 10,899,986. Process aids and catalysts, such as oleic acid and sulfonic acids, can also be part of the reaction mixture. Representative examples are shown in U.S. Pat. Nos. 3,697,574; 3,703,536; 3,704,308; 3,751,365; 3,756,953; 3,798,165; 3,803,039; 4,231,759; 9,938,479; 7,491,248; and 10,899,986, and WO 01/42399.

Dispersants of Polymethacrylate or Polyacrylate Derivatives

Polymethacrylate or polyacrylate derivatives are another class of dispersants useful herein. These dispersants are typically prepared by reacting a nitrogen-containing monomer and a methacrylic or acrylic acid esters containing 5-25 carbon atoms in the ester group. Representative examples are shown in U.S. Pat. Nos. 2,100,993 and 6,323,164. Polymethacrylate and polyacrylate dispersants are typically lower molecular weights.

The lubricating composition of the invention typically comprises dispersant at 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition. Alternately, the dispersant may be present at 0.1 wt % to 5 wt %, or 0.01 wt % to 4 wt %, or 0.05 wt % to 2 wt % of the lubricating composition.

For further information on dispersants useful herein, please see U.S. Pat. No. 10,829,712, column 13, line 36 to column 16, line 67 and 7,485,603, column 2, line 65 to column 6, line 22, column 8, line 25 to column 14, line 53, and column 23, line 40 to column 26, line 46.

J. Corrosion Inhibitors/Anti-Rust Agents

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur-containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, and derivatives of any one or more thereof. A particular corrosion inhibitor is a benzotriazole represented by the structure:

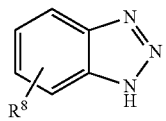

wherein $R^8$ is absent (hydrogen) or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. Non-limiting examples of such corrosion inhibitors may comprise or be benzotriazole, tolyltriazole, and/or optionally substituted benzotriazoles such as Irgamet™ 39, which is commercially available from BASF of Ludwigshafen, Germany. A preferred corrosion inhibitor may comprise or be benzotriazole and/or tolyltriazole.

Additionally or alternatively, the corrosion inhibitor may include a substituted thiadiazole represented by the structure:

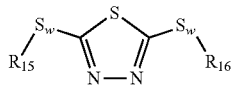

wherein, $R^{15}$ and $R^{16}$ are independently hydrogen or a hydrocarbon group, which group may be aliphatic or aromatic, including cyclic, alicyclic, aralkyl, aryl and alkaryl, and wherein each w is independently 1, 2, 3, 4, 5, or 6 (preferably 2, 3, or 4, such as 2). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure. For example, U.S. Pat. Nos. 2,719,125; 2,719,126; and 3,087,937 describe the preparation of various 2,5-bis-(hydrocarbon dithio)-1,3,4-thiadiazoles.

Further, additionally or alternatively, the corrosion inhibitor may include one or more other derivatives of DMTD, such as a carboxylic ester in which $R_{15}$ and $R_{16}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic carboxylic acids having at least 10 carbon atoms are described, for example, in U.S. Pat. No. 2,836,564. This process produces DMTD derivatives wherein $R_{15}$ and $R_{16}$ are HOOC—CH(R19), (R19 being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical Company.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further, additionally or alternatively, the corrosion inhibitor may include a trifunctional borate having the structure, $B(OR^{46})_3$, in which each $R^{46}$ may be the same or different. As the borate may typically be desirably compatible with the non-aqueous medium of the composition, each $R^{46}$ may comprise or be a hydrocarbyl $C_1$-$C_8$ moiety. For compositions in which the non-aqueous medium comprises or is a lubricating oil basestock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl) borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from about 0.001 wt % to 5.0 wt %, based on the weight of the composition, e.g., from 0.005 wt % to 3.0 wt % or from 0.01 wt % to 1.0 wt %. Alternately, such additives may be used in an amount of about 0.01 to 5 wt %, preferably about 0.01 to 1.5 wt %, based upon the weight of the lubricating composition.

In some embodiments, 3,4-oxypyridinone-containing compositions may contain substantially no (e.g., 0, or less than 0.001 wt %, 0.0005 wt % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

K. Anti-Wear Agents

Anti-wear agents described herein exclude compounds represented by the Formula (I) above. Compositions according to the present disclosure may contain an additive having a different enumerated function that also has secondary effects as an anti-wear (for example, organo-molybdenum friction modifiers (such as molybdenum dithiocarbamates, dialkyldithiophosphates, alkylxanthates and alkylthioxanthates) may also have anti-wear effects). These additives are not included as anti-wear additives for purposes of determining the amount of anti-wear additives in a lubricating oil composition or concentrate herein.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo, and the like) salts of dithiophosphates, metal (e.g., Zn, Pb, Sb, Mo, and the like) salts of dithiocarbamates, metal (e.g., Zn, Pb, Sb, and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 wt % to about 5 wt %, from about 0.05 wt % to about 3 wt %, or from about 0.1 wt % to about 1 wt %, based on the total weight of the lubricating oil composition.

In embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel, or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

Useful anti-wear agents also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithio phosphate in which the metal constituent is zinc, or zinc dialkyl dithio phosphate (ZDDP) can be a useful component of the lubricating compositions of this disclosure. ZDDP can be derived from primary alcohols, secondary alcohols or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be used. Alkyl aryl groups may also be used. Useful zinc dithiophosphates include secondary zinc dithiophosphates such as those available from The Lubrizol Corporation under the trade designations "LZ 677A", "LZ 1095", and "LZ 1371", from Chevron Oronite under the trade designation "OLOA 262" and from Afton Chemical under the trade designation "HITEC™ 7169".

The ZDDP is typically used in amounts of from about 0.4 wt % to about 1.2 wt 00 preferably from about 0.5 wt % to about 1.0 wt %, and more preferably from about 0.6 wt % to about 0.8 wt %, based on the total weight of the lubricating composition, although more or less can often be used advantageously. Preferably, the ZDDP is a secondary ZDDP and present in an amount of from about 0.6 to 1.0 wt % of the total weight of the lubricating composition.

In embodiments, the zinc compound can be a zinc dithiocarbamate complex, such as the zinc dithiocarbamates represented by the formula:

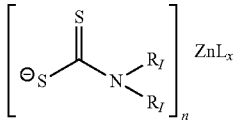

where each $R_1$ is independently a linear, cyclic, or branched, saturated or unsaturated, aliphatic hydrocarbon moiety having from 1 to about 10 carbon atoms, n is 0, 1, or 2, L is a ligand that saturates the coordination sphere of zinc, and x is 0, 1, 2, 3, or 4. In certain embodiments, the ligand, L, is selected from the group consisting of water, hydroxide, ammonia, amino, amido, alkylthiolate, halide, and combinations thereof.

The ZDDP and or the zinc carbamates are typically used in amounts of from about 0.4 wt % to about 1.2 wt %, preferably from about 0.5 wt % to about 1.0 wt %, and more preferably from about 0.6 wt % to about 0.8 wt %, based on the total weight of the lubricating composition, although more or less can often be used advantageously. Preferably, the ZDDP is a secondary ZDDP and present in an amount of from about 0.6 to 1.0 wt % of the total weight of the lubricating composition.

Anti-wear additives useful herein also include boron-containing compounds, such as borate esters, borated fatty amines, borated epoxides, alkali metal (or mixed alkali metal or alkaline earth metal) borates and borated overbased metal salts.

Other Additives

Other optional additives include de-emulsifiers, see U.S. Pat. No. 10,829,712 (Col 20, lines 34 to 40). Typically, a small amount of a demulsifying component may be used herein. A preferred demulsifying component is described in EP 330,522. It is obtained by reacting an alkylene oxide with an adduct obtained by reacting a bis-epoxide with a polyhydric alcohol.

Other optional additives include seal compatibility agents such as organic phosphates, aromatic esters, aromatic hydrocarbons, esters (butylbenzyl phthalate, for example), and polybutenyl succinic anhydride. Such additives may be used in an amount of about 0.001 to 5 wt %, preferably about 0.01 to 2 wt %.

When lubricating oil compositions contain one or more of the additives discussed above, the additive(s) are typically blended into the composition in an amount sufficient for it to perform its intended function. Typical amounts of such additives useful in the present disclosure, especially for use in crankcase lubricants, are shown in the table below.

It is noted that many of the additives are shipped from the additive manufacturer as a concentrate, containing one or more additives together, with a certain amount of base oil or other diluents. Accordingly, the weight amounts in the table below, as well as other amounts mentioned herein, are directed to the amount of active ingredient (that is the non-diluent portion of the ingredient). The weight percent (mass %) indicated below is based on the total weight of the lubricating oil composition.

Typical Amounts of Optional Lubricating Oil Components

| ADDITIVE FORMULATIONS | A (mass %) | B (mass %) |
|---|---|---|
| Dispersant | 0.1-20 | 1-8 |
| Detergent | 0.1-20 | 0.2-9 |
| Corrosion Inhibitor Anti-rust | 0-5 | 0-1.5 |
| Antioxidant | 0-5 | 0.01-2.5 |
| Pour Point Depressant | 0.01-5 | 0.01-1.5 |
| Anti-foaming Agent | 0-5 | 0.001-0.15 |
| Metal alkanoate | 0.01-10 | 0.1-5 (such as 0.1 to 1 ) |
| Supplemental Anti-wear Agents [different from the metal alkanoates of Formula (I)], such as ZDDP | 0-1.0 | 0.1-0.5 |
| Friction Modifier | 0-5 | 0-1.5 |
| Viscosity Modifier | 0.01-10 | 0.25-3 |

-continued

| ADDITIVE FORMULATIONS | A (mass %) | B (mass %) |
|---|---|---|
| Optional additional additives | 0-10 | 0-5 |
| Dispersant Viscosity Modifier | 0-10 | 0.01-5 |
| Basestock | Balance | Balance |

The foregoing additives are typically commercially available materials. These additives may be added independently, but are usually pre-combined in packages which can be obtained from suppliers of lubricant oil additives. Additive packages with a variety of ingredients, proportions and characteristics are available and selection of the appropriate package will take the use of the ultimate composition into account.

In another aspect, the lubricating oil compositions described herein contain from 500 to 3000 ppm, alternately 500 to 2800 ppm, of group 4, 5, 10, 11, 12, or 13 metal (such as group 10, 11, 12, or 13 metal).

Preferably the lubricating oil composition described herein contain from 500 to 3000 ppm, alternately 500 to 2800 ppm, of metal selected from the group consisting of nickel, palladium, platinum, copper, silver, gold, zinc, tin, zirconium, hafnium, titanium, vanadium, niobium, and tantalum (such as zinc).

Alternately, the lubricating oil composition described herein contains from 500 to 3000 ppm, alternately 500 to 2800 ppm, alternately 500 to 2000 ppm, of zinc derived from the zinc alkanoate.

Alternately, the lubricating oil composition described herein contains from 600 to 4000 ppm, alternately 700 to 3000 ppm, alternately 800 to 2000 ppm, of zinc derived from the zinc alkanoate and any ZDDP (zinc dialkyldithiophosphate) and or ZDDC (zinc dialkyldithiocarbamate) present.

Alternately, zinc dialkyl dithiophosphates are present in the lubricating compositions described herein at 1 mass % or less, such as 0.5 mass % or less, such as 0.1 mass % or less, such as 0.01 mass % or less.

Alternately, zinc dialkyldithiocarbamate are present in the lubricating compositions described herein at 1 mass % or less, such as 0.5 mass % or less, such as 0.1 mass % or less, such as 0.01 mass % or less.

Alternately, zinc dialkyl dithiophosphates and zinc dialkyldithiocarbamates are present in the lubricating compositions described herein at 1 mass % or less, such as 0.5 mass % or less, such as 0.1 mass % or less, such as 0.01 mass % or less.

Alternately, the lubricating composition described herein has an adhesive wear result of 100 hours or more (ASTM D8074-16) and a ratio of Zn to P (elemental mass basis) of 1.1 to 4.8 (such as 1.1 to 4.7, or 1.2 to 4.7, or 1.3 to 4.5, or 2.5 to 4.0) by wt %, where the lubricating composition contains a zinc-containing compound other than zinc dialkyl dithiophosphate and or zinc dialkyldithiocarbamate.

Alternately, the lubricating composition described herein has an adhesive wear of 100 hours or more (ASTM D8074-16) and at least 1000 ppm zinc, where the lubricating composition contains a zinc-containing compound other than zinc dialkyl dithiophosphate and or zinc dialkyldithiocarbamate.

Alternately, the lubricating composition described herein has an adhesive wear of 100 hours or more (ASTM D8074-16).

According to yet a further aspect of the present invention, lubricating oil composition has a ratio of M to phosphorus of 1.1 to 4.8 (such as 1.1 to 4.7, or 1.2 to 4.7, or 1.3 to 4.5, or 2.5 to 4.0) by wt %, where M is a group 4, 5, 10, 11, 12, or 13 metal, preferably the M provided by the metal alkanoate(s) as defined in Formula (I).

Fuels

This invention also relates to a method of lubricating an automotive internal combustion engine during operation of the engine comprising:

(i) providing to a crankcase of the automotive internal combustion engine an automotive crankcase the lubricating composition comprising metal alkanoate described herein;

(ii) providing a hydrocarbon fuel in the automotive internal combustion engine; and (iii) combusting the fuel in the automotive internal combustion engine, such as a spark-ignited or compression-ignited two- or four-stroke reciprocating engine, such as a diesel engine or passenger car engine (such as a spark-ignited combustion engine).

This invention also relates to a fuel composition comprising the lubricating oil compositions (or components thereof, including detergent and one or more metal alkanoates) described herein and a hydrocarbon fuel, wherein the fuel may be derived from petroleum and or biological sources ("biofuel" or "renewable fuel"). In embodiments, the fuel comprises from 0.1 to 100 mass % renewable fuel, alternately from 1 to 75 mass % renewable fuel, alternately from 5 to 50 mass % renewable fuel, based upon the total mass of the from 1 to 50 mass % renewable fuel and the petroleum derived fuel.

The renewable fuel component is typically produced from vegetable oil (such as palm oil, rapeseed oil, soybean oil, jatropha oil), microbial oil (such as algae oil), animal fats (such as cooking oil, animal fat, and/or fish fat), biogas, hydrogen and or ammonia. Renewable fuel refers to hydrogen, ammonia and biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges which provide the desired properties to the component, depending on the intended use.

Uses

The lubricating oils described herein are useful in a range of internal combustion engines such as compression-ignited and spark-ignited two- or four-cylinder reciprocating engines. Examples include engines for passenger cars, light commercial vehicles and heavy-duty on-highway trucks; engines for aviation, power-generation, locomotive, and marine equipment/engines; and heavy-duty off-highway engines such as may be used for agriculture, construction, and mixing.

The lubricating compositions of the invention may be useful as marine lubricants, such as trunk piston engine oils (TPEOs), MDCLs (marine diesel cylinder lubricants), system oils, and such.

Also, the lubricating compositions of the invention may be useful as lubricants for natural gas engines [e.g., natural gas is the fuel the engines run on, commonly called GEOs or (natural) gas engine oils].

Also, the lubricating compositions of the invention may be useful as lubricants for hydrogen engines, ammonia engines and the like [e.g., hydrogen (or hydrogen combined with natural gas) and or ammonia (or ammonia combined with hydrocarbon fuel, such as gasoline or diesel fuel) is the fuel the engines use].

The lubricating compositions of the invention may be used to lubricate mechanical engine components, particularly in internal combustion engines, e.g., spark-ignited or compression-ignited two- or four-stroke reciprocating engines, by adding the lubricant thereto. Typically, they are crankcase lubricants, such as passenger car motor oils or heavy-duty diesel engine lubricants.

In particular, the lubricating compositions of the present invention are suitably used in the lubrication of the crankcase of a compression-ignited internal combustion engine, such as a heavy-duty diesel engine. The lubricating compositions described herein are particularly suitable for internal combustion engines that are prone to piston-liner wear from a long duration of operation, hence the invention might extend engine lifetime.

In particular, the lubricating compositions of the present invention are suitably used in the lubrication of the crankcase of a spark-ignited turbo charged internal combustion engine.

The lubricating oils of this disclosure are particularly useful in high compression spark ignition internal combustion engines.

The lubricating oils described herein are also useful for lubricating a hydrogen or ammonia fueled internal combustion engine during operation of the engine comprising:

(i) providing to an internal combustion engine, such as to a crankcase, the lubricating composition comprising metal alkanoate, as described herein:

(ii) providing fuel comprising hydrogen and or ammonia to the internal combustion engine; and (iii) combusting the fuel in an internal combustion engine, such as a hydrogen or ammonia fueled engine.

This invention further relates to:

1. A lubricating composition comprising or resulting from the admixing of: base oil, detergent, and one or more metal alkanoates (such as 5, 10, 11, 12, or 13 metal alkanoates, preferably not group 4 metal alkanoate, such as not titanium alkanoate, such as not zirconium alkanoate, such as not hafnium alkanoate) having a quaternary carbon atom at the 2 position, the 2' position, or both the 2 and 2' positions, where the lubricating composition has: an adhesive wear of 100 hours or more, a foam volume of 70 ml or less at 24° C. and 50 ml or less at 93.5° C., and optionally a total base number of 7 mgKOH/g or more.

2. The lubricating composition of paragraph 1, wherein the metal alkanoate is represented by the Formula (I):

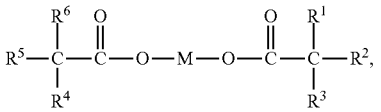

(I)

wherein,

M is a group 10, 11, or 12 metal, such as zinc;

$R^1$ is H or $C_1$ to $C_{20}$ linear, branched, or cyclic alkyl group, $R^2$, $R^3$, $R^4$, $R^5$, and $R^6$ are, independently, a $C_1$ to $C_{20}$ linear, branched, or cyclic alkyl group.

3. The lubricating composition of paragraph 1 or 2, further comprising one or more of the following components.

D) one or more friction modifiers;

E) one or more antioxidants;

F) one or more pour point depressants;

G) one or more anti-foaming agents;

H) one or more viscosity modifiers;

I) one or more dispersants;

J) one or more inhibitors and/or anti-rust agents; and/or

K) one or more anti-wear agents, not falling within Formula (I).

4. The lubricating composition of paragraph 1, 2, or 3, wherein:

A) the base oil is present at 1 to 99 mass % based upon the weight of the lubricating composition; and B) the detergent is present at from 0.1 to 20 wt % based on total weight of the lubricating composition; and C) the metal alkanoate is present at from 0.1 to 5 wt % based on total weight of the lubricating composition.

5. The lubricating composition of paragraph 4, wherein:

E) optionally, one or more antioxidants are present at from 0.01 to 5 wt %, based on total weight of the lubricating composition;

F) optionally, one or more pour point depressants are present at from 0.01 to 5 wt 00 based on total weight of the lubricating composition;

G) optionally, one or more anti-foaming agents are present at from 0.001 to 5 wt 00 based on total weight of the lubricating composition;

H) optionally, one or more viscosity modifiers are present at from 0.001 to 6 wt %, based on total weight of the lubricating composition;

I) optionally, one or more dispersants are present at from 0.01 to 20 wt %, based on total weight of the lubricating composition;

J) optionally, one or more inhibitors and/or anti-rust agents are present at from 0.01 to 5 wt %, based on total weight of the lubricating composition; and K) optionally, one or more anti-wear agents, other than those of component C), are present at from 0.001 to 5 wt %, based on total weight of the lubricating composition.

6. The lubricating composition of any of the above paragraphs 1 to 5, wherein the lubricating composition has an adhesive wear of 120 hours or more.

7. The lubricating composition of any of the above paragraphs 1 to 6 further comprising a phosphorus containing component (such as ZDDP), wherein the ratio of metal (such as M of formula (I), or zinc) to P is 1.1 to 4.7 by wt %, or 3.0 to 3.5 by wt %.

8. The lubricating composition of any of the above paragraphs 1 to 7, wherein the alkanoate is derived from a neoacid.

9. The lubricating composition of any of the above paragraphs 1 to 8 having at least 1000 ppm zinc.

10. The lubricating composition of any of the above paragraphs 1 to 9, wherein the sum of the number of carbon atoms in $R^1$, $R^2$, and $R^3$ is 7 or more carbon atoms and the sum of the number of carbon atoms in $R^4$, $R^5$, and $R^6$ is 7 or more carbon atoms.

11. The lubricating composition of any of the above paragraphs 1 to 10, wherein the metal alkanoate is a $C_{18}$ to $C_{60}$ zinc neoalkanoate.

12. The lubricating composition of any of the above paragraphs 1 to 11, wherein the metal alkanoate is one or more of zinc neodecanoate, zinc neoundecanoate, zinc neododecanoate, zinc neotridecanoate, zinc neotetradecanoate, zinc neopentadecanoate, zinc neohexadecanoate, zinc neoheptadecanoate, zinc neooctadecanoate, zinc neononadecanoate, and zinc neoeicosanoate.

13. The lubricating composition of any of the above paragraphs 1 to 12, wherein the metal alkanoate is liquid at −15° C. and liquid at 80° C.

14. The lubricating composition of any of the above paragraphs 1 to 13, wherein the lubricating composition is a heavy-duty diesel engine oil or a marine engine oil.

15. The lubricating composition of any of the above paragraphs 1 to 14 comprising more than 1000 ppm of zinc and less than 1000 ppm P, where the lubricating composition has an adhesive wear of 100 hours or more, a foam volume of 70 ml or less at 24° C. and 50 ml or less at 93.5° C., and optionally a total base number of 7 mgKOH/g or more.

16. The lubricating composition of any of the above paragraphs 1 to 15, wherein the ratio of Zn to P is 1.1 to 4.8 (such as 1.1 to 4.7, or 1.2 to 4.7, or 1.3 to 4.5, or 2.5 to 4.0, or 3.0 to 3.5, or 3.0 to 3.4) by wt %.

17. The lubricating composition of any of the above paragraphs 1 to 16, wherein zinc dialkyl dithiophosphates are present at 1 mass % or less.

18. A lubricating composition having an adhesive wear result of 100 hours or more (ASTM D8074-16) and a ratio of Zn to P (elemental mass basis) of 1.1 to 4.8 (such as 1.1 to 4.7, or 1.2 to 4.7, or 1.3 to 4.5, or 2.5 to 4.0, or 3.0 to 3.5, or 3.0 to 3.4) by wt % where the lubricating composition contains a zinc-containing compound other than zinc dialkyl dithiophosphate (optionally other than zinc dialkyl dithiophosphate and or zinc dialkyl dithiocarbamate).

19. A lubricating composition having an adhesive wear of 100 hours or more (ASTM D8074-16) and at least 1000 ppm zinc, where the lubricating composition contains a zinc-containing compound other than zinc dialkyl dithiophosphate (optionally other than zinc dialkyl dithiophosphate and or zinc dialkyl dithiocarbamate).

20. A method to obtain an adhesive wear of 100 hours or more (ASTM D8074-16) for a lubricating composition having 1000 ppm zinc or more comprising:

(i) providing to a crankcase of the internal combustion engine the lubricating composition of any of paragraphs 1 to 19;

(ii) providing a hydrocarbon fuel in the internal combustion engine; and (iii) combusting the fuel in the internal combustion engine.

21. A method of lubricating an automotive internal combustion engine during operation of the engine comprising:

(i) providing to a crankcase of the internal combustion engine an automotive crankcase the lubricating composition of any of paragraphs 1 to 19;

(ii) providing a hydrocarbon fuel in the internal combustion engine; and (iii) combusting the fuel in the internal combustion engine.

22. The method of paragraph 21, wherein the engine is a diesel engine.

23. The method of paragraph 21, wherein the engine is a marine engine.

24. The method of paragraph 21, wherein the engine is an automotive engine.

25. The use of a lubricating composition of any of paragraphs 1 to 19 as an additive in an oil composition to obtain an adhesive wear of 100 hours or more (ASTM D8074-16) in an internal combustion engine lubricated by the composition.

26. The use of paragraph 25, wherein the lubricating composition has a foam volume of 70 ml or less at 24° C. and 50 ml or less at 93.5° C., and optionally a total base number of 7 mgKOH/g or more.

27. The use of paragraph 25 or 26, where the internal combustion engine is lubricated by:

(i) providing the lubricating composition of any of claims 1 to 19 to a crankcase of the internal combustion engine, where the lubricating composition has 1000 ppm zinc or more;

(ii) providing a hydrocarbon fuel in the internal combustion engine; and (iii) combusting the fuel in the internal combustion engine.

28. The use of paragraph 25 or 26, where the lubricating oil composition has:

1) an adhesive wear of 100 hours or more, such as 140 hours or more (as determined by ASTM D8074-16), and 2) more than 800 ppm of zinc (such as 1000 ppm o more) and less than 1000 ppm phosphorus, and 3) a ratio of zinc to phosphorus of 1.1 to 4.8. (such as 1.1 to 4.7, or 1.2 to 4.7, or 1.3 to 4.5, or 2.5 to 4.0, or 3.0 to 3.5, or 3.0 to 3.4) by wt %.

29. The composition of any of paragraphs 1 to 19 where the metal, such as M in formula (I), is not a group 4 metal, preferably is not titanium.

30. A method of lubricating a hydrogen and or ammonia fueled internal combustion engine during operation of the engine comprising:

(i) providing to a crankcase of the internal combustion engine a lubricating composition comprising a detergent and one or more metal alkanoates having a quaternary carbon atom at the 2 position, the 2' position, or both the 2 and 2' positions;

(ii) providing fuel comprising hydrogen and or ammonia in the internal combustion engine; and (iii) combusting the fuel in the internal combustion engine.

31. The method of paragraph 30 wherein the lubricating composition is a composition of any of paragraphs 1 to 19.

32. A use, in the lubrication of an internal combustion engine, of a metal salt of an alkyl neo-monocarboxylic acid and a detergent as a combination of additives, in an effective minor amount, in a lubricating oil composition to reduce adhesive wear in said internal combustion engine during lubrication of said engine is a composition of any of paragraphs 1 to 19.

33. A use, in the lubrication of an internal combustion engine, of a metal salt of an alkyl neo-monocarboxylic acid and a detergent as a combination of additives, in an effective minor amount, in a lubricating oil composition to reduce foaming in said internal combustion engine during lubrication of said engine is a composition of any of paragraphs 1 to 19.

34. The use of claim 32 or 33 wherein the lubricating oil composition has a ratio of zinc to phosphorus of 1.1 to 4.8 by wt % or 3.0 to 3.5 by wt % or 3.0 to 3.4 by w %.

The following non-limiting examples are provided to illustrate the disclosure.

Experimental

All molecular weights are number average unless otherwise noted.

Testing Procedures

Total Base Number is determined according to ASTM D2896 and reported in units of mgKOH/g.

HTHS150 (High Temperature High Shear 150) is determined according to ASTM D4683-20 and reported in units of centipoise (cP).

Viscosity index is measured according to ASTM D2270.

$KV_{100}$ is Kinematic viscosity measured at 100° C. according to ASTM D445-19a.

Phosphorus content was determined by ASTM D5185.

Zinc content was determined by ASTM D5185.

Adhesive Wear testing was performed according to ASTM D8074-16. The DD13 Scuffing Test (ASTM D8074-16) evaluates the liner scuffing and ring distress performance of engine oils in turbocharged and intercooled four-cycle diesel engines equipped with exhaust gas recycling (EGR), uncoated top rings, and running on ultra-low sulfur diesel fuel. The test engine is a four stroke Detroit Diesel DD13 12.8 L, six-cylinder diesel engine with EGR. The engine is disassembled prior to each test, the parts solvent-cleaned and measured, and rebuilt using all new pistons, uncoated rings, cylinder liners, and connecting rod bearings. The test is performed using ASTM D8074-16 Standard Test Method for Evaluation of Diesel Engine Oils in DD13 Diesel Engine, version 20170104, where the time to scuff determination is from an end of test rating liner scuffing which is to not exceed 27%, a change in iron between any 2-hour interval which is not to exceed 25 ppm, and a crankcase pressure which is not to exceed 2 kPa absolute. The pass limit to meet the specification set by Detroit Diesel is the time to scuff of 31 hours minimum.

Foaming Characteristics of engine lubricants were determined according to ASTM D892, Option A. This test assesses the foaming tendency and stability of lubricating oils. The method consists of three sequences. In sequence I, a portion of the engine lubricant sample is maintained at 24° C. in foaming cylinder, while it is blown with air at a constant rate for 5 minutes. After the blowing stops, the amount of foam is recorded. Then the foam is allowed to settle for 10 minutes, then the amount of foam is recorded again. For sequence II, a second portion of the sample follows the same process as sequence I but at a temperature of 93.5° C. instead. In sequence III, the same sample from sequence II is cooled to room temperature until the sample is below 43.5° C. Then the sample is maintained at 24° C. and sequence I is repeated.

Materials

PIB is polyisobutylene.

PIBSA is polyisobutylene succinic anhydride.

A.I. or a.i. is active ingredient.

Mn is number average molecular weight.

EXAMPLES

The invention will now be described in the following examples which are not intended to limit the scope of the claims hereof.

A series of 10W-30 engine lubricants, shown in Table 1 below, were prepared for testing in DD13 scuffing test by admixing the additives listed below with base oils and viscosity modifier at 60° C. Examples 1, 3, and 5 represent comparative lubricating oil compositions having no metal alkanoate, whereas Examples 2 and 4 represent lubricating oil compositions of the present invention. Full details of the formulations used are listed below:

TABLE 1

| Example | 1 | 2 | 3 | 4 | 5 |
|---|---|---|---|---|---|
| Components | | | | | |
| Borated PIBSA-PAM | 0.5 | 0.5 | 0.5 | 0.5 | 0.5 |
| Chlorinated-PIBSA-PAM | 4 | 4 | 4 | 4 | 4 |
| PIBSA-ester[1] | 1.75 | 1.75 | 0.5 | 0.5 | 0.5 |
| PIBSA-PAM | 4 | 4 | 4 | 4 | 4 |
| Amine funct. polyisoprene[2] | 1.56 | 1.56 | 1.56 | 1.56 | 1.56 |
| Ca sulfonate | 0.6 | — | 0.333 | 0.1 | — |
| Mg sulfonate | 0.85 | 0.85 | 0.475 | 0.475 | 0.475 |
| Ca phenate | 0.8 | 0.8 | 0.447 | 0.447 | 0.07 |
| ZDDP | 1 | 1 | 0.64 | 0.64 | 0.64 |
| Mo Friction Modifier | 0.12 | 0.12 | 0.12 | 0.12 | 0.12 |
| Diarylamine antioxidant | 2.5 | 2.5 | 2 | 2 | 2 |
| Fatty acid methyl ester antioxidant | 0.8 | 0.8 | 0.8 | 0.8 | 0.8 |
| Zn Neodecanoate | — | 1 | — | 0.5 | 1.0 |
| PDMS anti-foamant | 0.008 | 0.008 | 0.008 | 0.008 | 0.008 |
| Polyisobutylene Mn~1000 | 0.6 | 0.6 | 1.6 | 1.6 | 1.6 |
| Flow improver | 0.2 | 0.2 | 0.2 | 0.2 | 0.2 |
| Group I oil | 2.012 | 2.612 | 2.062 | 2.062 | 2.062 |
| Visc. modifier 830 cSt $KV_{100}$ | 0.5 | 0.5 | 1.5 | 1.5 | 1.5 |
| Group II 4.5 cSt base oil | 58.2 | 57.2 | 58.855 | 58.588 | 58.565 |
| Group II 6.5 cSt base oil | 20 | 20 | 20 | 20 | 20 |
| Properties | | | | | |
| HTHS150 (cP) | 2.98 | 3.0 | 3.08 | 3.13 | 3.17 |
| TBN (mgKOH/g) | 12.9 | 13.6 | 9.1 | 9.9 | 10.7 |
| Phosphorus ppm | 800 | 800 | 500 | 500 | 500 |
| Zinc ppm | 880 | 2701 | 560 | 1517 | 2440 |
| Zinc:Phosphorous ratio | 1.1 | 3.38 | 1.12 | 3.03 | 4.88 |

TABLE 1-continued

| Example | 1 | 2 | 3 | 4 | 5 |
|---|---|---|---|---|---|
| DD13 Scuffing Test (hours, each number represent a repeat of the oil in DD13 scuff test. | 40, 31 | 162, 31, 142 | 31, 31 | 182, 37, 62 | 31, 8 |

1. PIBSA ester prepared in a manner similar to Example 1 of U.S. 2009/0203559.

2. 7.2% amine functionalized hydrogenated polyisoprene prepared as described in concurrently filed in U.S. Ser. No. 63/379,006 filed Oct. 11, 2022 and entitled *Functionalized $C_{4\ to\ 5}$ Olefin Polymers and Lubricant Compositions Containing Such.*

Each sample was evaluated according to the DD13 scuffing test and the results demonstrate that lubricating oil compositions including zinc alkanoate, specifically zinc neodecanoate, were able to improve the engine's scuffing performance at both a 500 ppm and 800 ppm phosphorus environment. By adjusting the amount of zinc alkanoate added in lubricating oil composition to achieve zinc to phosphorus ratios between 3.0 to 3.5, such as 3.0 to 3.4, such as 3.03 to 3.38 (Examples 2 and 4), a drastic improvement in scuffing performance was observed over comparative Examples 1 and 3. Furthermore, Example 5 exemplifies a loss in enhanced scuffing performance when zinc-to-phosphorus ratio is too high.

Four blends were then evaluated for foaming characteristics (reported in Table 2 below). Example 6 was obtained by firstly dissolving Mg salicylate/sulphonate detergents in base oil at 130° C. and then zinc stearate was added periodically to the mixture, at 130° C., over a period of 4 hours. Once the mixture was homogeneous, it was further mixed for 1 hour at 95 TC. For Examples 7, 8 and 9, the Mg salicylate/sulphonate detergents, the corresponding metal carboxylate (i.e., zinc neodecanoate, zinc 2-ethylhexanoate and zirconium (2-ethylhexanote) andbase oil were mixed together at 95° C., for 1 hour, to achieve a homogeneous mixture.

TABLE 2

| Components | Example 6 | Example 7 | Example 8 | Example 9 |
|---|---|---|---|---|
| Mg salicylate/Mg Sulphonate detergents | 1.0 | 1.0 | 1.0 | 1.0 |
| Zinc Neodecanoate | — | 0.57 | — | — |
| Zinc Stearate | 1.0 | — | — | — |
| Zinc (2-ethylhexanoate) | — | — | 0.58 | — |
| Zirconium (2-ethylhexanote) | — | — | — | 0.82 |
| Base oil | 98.0 | 98.43 | 98.42 | 98.18 |
| Properties | | | | |
| Zinc ppm (ASTM D5185) | 942 | 957 | 1040 | |
| Zirconium ppm (ASTM D5185) | — | — | — | 914 |
| Foaming Characteristics | | | | |
| Foaming vol. seq. I @ 24° C., 5 min (mL) | 630 | 10 | 230 | 330 |
| Settling vol. seq. I @ 24° C., 10 min (mL) | 560 | 0 | 0 | 0 |
| Foaming vol. seq. II @ 93.5° C., 5 min (mL) | 650 | 30 | 40 | 40 |
| Settling vol. seq. II @ 93.5° C., 10 min (mL) | 60 | 0 | 0 | 0 |
| Foaming vol. seq. III @ 24° C., 5 min (mL) | 600 | 70 | 130 | 230 |
| Settling vol. seq. III @ 24° C., 10 min (mL) | 550 | 0 | 0 | 0 |

The foaming tendencies and stability results demonstrate that the use of zinc stearate, zinc (2-ethylhexanoate) and zirconium (2-ethylhexanoate) cause foaming stability issues at both 24° C. and 93.5° C. (Example 6, 8, and 9). By introducing zinc neodecanoate instead of the other tested metal carboxylates, at matched metal level, the foaming stabilities of the oil composition drastically improve (Example 7). Therefore, in order to gain exceptional DD13 scuffing performance, with no foaming stability issues, zinc neodecanoate is preferred.

Figure 3:
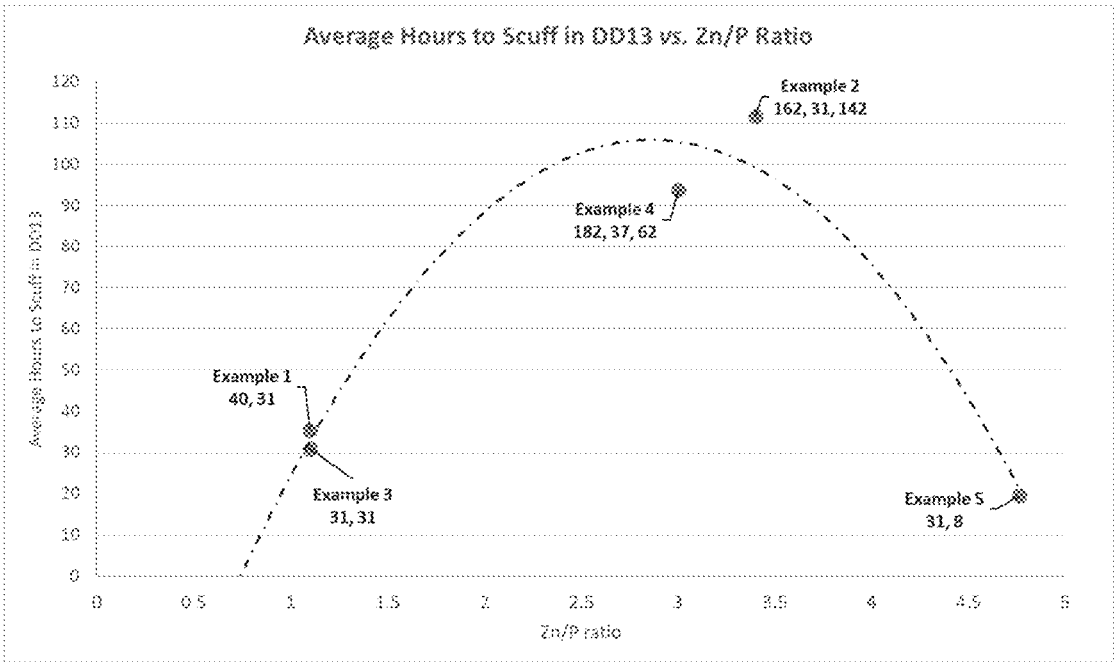
FIG. 3 (FIG. 3) is a graph illustrating adhesive wear data for blends containing zinc neodecanoate (Examples 2, 4, & 5), where the data are averaged.

DD13 data can be variable, however when averaged trends can be identified. See FIG. 3.

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" specifies the presence of stated features, steps, integers, or components, but does not preclude the presence or addition of one or more other features, steps, integers, components, or groups thereof. Likewise, the term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa.

What is claimed is:

1. A lubricating composition comprising or resulting from the admixing of: base oil at from 70 to 85 wt. %, detergent at from 0.5 to 2.3 wt. % selected from the group consisting of calcium sulfonate, magnesium sulfonate, calcium phenate and combinations thereof, zinc dialkyl dithiophosphate at from 0.64 wt. % to 1.0 wt. % to contribute from 500 to 800 ppm phosphorous to the lubricating composition, and zinc neodecanoate at from 0.5 wt. % to 3.0 wt. %, wherein the lubricating composition has a zinc to phosphorous ratio ranging from 3.0 to 3.5 by wt. %, and where the lubricating composition has: an adhesive wear of 100 hours or more, as determined by ASTM D8074-16, and optionally a total base number of 7 mgKOH/g or more.

2. The lubricating composition of claim 1, wherein the base oil is selected from the group consisting of Group I, Group II and combinations thereof.

3. The lubricating composition of claim 1, further comprising one or more of the following components:

D) one or more friction modifiers;
E) one or more antioxidants;
F) one or more pour point depressants;
G) one or more anti-foaming agents;
H) one or more viscosity modifiers;
I) one or more dispersants; and/or
J) one or more inhibitors and/or anti-rust agents.

4. The lubricating composition of claim 1, wherein:

A) the base oil is present at 79.8 to 82.2 mass % based upon the weight of the lubricating composition; and
B) the detergent is present at from 1.0 to 1.65 wt % based on total weight of the lubricating composition; and
C) the zinc neodecanoate is present at from 0.5 to 1.0 wt % based on total weight of the lubricating composition.

5. The lubricating composition of claim 4 wherein:

E) optionally, one or more antioxidants are present at from 0.01 to 5 wt %, based on total weight of the lubricating composition;
F) optionally, one or more pour point depressants are present at from 0.01 to 5 wt %, based on total weight of the lubricating composition;
G) optionally, one or more anti-foaming agents are present at from 0.001 to 5 wt %, based on total weight of the lubricating composition;
H) optionally, one or more viscosity modifiers are present at from 0.001 to 6 wt %, based on total weight of the lubricating composition;
I) optionally, one or more dispersants are present at from 0.01 to 20 wt %, based on total weight of the lubricating composition; and
J) optionally, one or more inhibitors and/or anti-rust agents are present at from 0.01 to 5 wt %, based on total weight of the lubricating composition.

6. The lubricating composition of claim 1 having at least 1000 ppm zinc.

7. The lubricating composition of claim 1, wherein the ratio of Zn to P is 3.03 to 3.38 by wt %.

8. A method to obtain an adhesive wear of 100 hours or more, as determined by ASTM D8074-16, for a lubricating composition have 1000 ppm zinc or more comprising:

(i) providing to a crankcase of the internal combustion engine of the lubricating composition of claim 1;
(ii) providing a hydrocarbon fuel in the internal combustion engine; and
(iii) combusting the fuel in the internal combustion engine.

9. A method of lubricating an internal combustion engine during operation of the engine comprising:

(i) providing to a crankcase of the internal combustion engine the lubricating composition of claim 1;
(ii) providing a hydrocarbon fuel in the internal combustion engine; and
(iii) combusting the fuel in the internal combustion engine.

10. A method of lubricating an internal combustion engine during operation of the engine comprising:

(i) providing to a crankcase of the internal combustion engine a lubricating composition comprising base oil at from 70 to 85 wt. %; detergent at from 0.5 to 2.3 wt. % selected from the group consisting of calcium sulfonate, magnesium sulfonate, calcium phenate and combinations thereof; zinc dialkyl dithiophosphate at from 0.64 wt. % to 1.0 wt. % to contribute from 500 to 800 ppm phosphorous to the lubricating composition; and zinc neodecanoate at from 0.5 wt. % to 3.0 wt. %;
(ii) providing a hydrocarbon fuel in the internal combustion engine;
(iii) combusting the fuel in the internal combustion engine;
(iv) obtaining an adhesive wear of 100 hours or more, as determined by ASTM D8074-16, in the internal combustion engine lubricated by the composition; and
(v) wherein the lubricating composition has a zinc to phosphorous ratio ranging from 3.0 to 3.5 by wt. %, and a total base number of 7 mgKOH/g or more.

11. The method of claim 9 wherein the zinc to phosphorus ratio is between 3.03 to 3.38 by wt %, and wherein the base oil is selected from Group I, Group II, and combinations thereof.

12. The method claim 9 wherein the engine is a diesel engine.

13. The method claim 9 wherein the engine is a marine engine.

14. The method claim 9 wherein the engine is an automotive engine.

15. The lubricating composition of claim 1 where the lubricating composition has an adhesive wear of 120 hours or more.

16. The lubricating composition of claim 1 wherein the zinc neodecanoate is liquid at −15° C. and liquid at 80° C.

17. The lubricating composition of claim 1 wherein the lubricating composition is a heavy-duty diesel engine oil or a marine engine oil.

18. A method of lubricating a hydrogen and or ammonia fueled internal combustion engine during operation of the engine comprising:

(i) providing to a crankcase of the internal combustion engine a lubricating composition comprising base oil at from 70 to 85 wt. %, detergent at from 0.5 to 2.3 wt. % selected from the group consisting of calcium sulfonate, magnesium sulfonate, calcium phenate and combinations thereof; zinc dialkyl dithiophosphate at from 0.64 wt. % to 1.0 wt. % to contribute from 500 to 800 ppm phosphorous to the lubricating composition; and zinc neodecanoate at from 0.5 wt. % to 3.0 wt. %;
(ii) providing fuel comprising hydrogen and or ammonia in the internal combustion engine; and
(iii) combusting the fuel in the internal combustion engine; and wherein the lubricating composition has a zinc to phosphorous ratio ranging from 3.0 to 3.5 by wt. %, an adhesive wear of 100 hours or more, as determined by ASTM D8074-16, and a total base number of 7 mgKOH/g or more.

* * * * *